US008813732B2

(12) United States Patent
Kataoka et al.

(10) Patent No.: US 8,813,732 B2
(45) Date of Patent: Aug. 26, 2014

(54) INTERNAL COMBUSTION ENGINE CONTROL SYSTEM

(75) Inventors: Naoki Kataoka, Osaka (JP); Yoshiyuki Fukumura, Osaka (JP)

(73) Assignee: Diamond Electric Mfg. Co., Ltd., Osaka-Shi, Osaka (JP)

( * ) Notice: Subject to any disclaimer, the term of this patent is extended or adjusted under 35 U.S.C. 154(b) by 716 days.

(21) Appl. No.: 13/149,433

(22) Filed: May 31, 2011

(65) Prior Publication Data

US 2012/0017881 A1 Jan. 26, 2012

(30) Foreign Application Priority Data

Jul. 22, 2010 (JP) ..... P.2010-164927
Aug. 31, 2010 (JP) ..... P.2010-193133

(51) Int. Cl.

| | |
|---|---|
| ***F02P 3/04*** | (2006.01) |
| *F02P 13/00* | (2006.01) |
| *F02P 15/10* | (2006.01) |
| *F02P 15/00* | (2006.01) |

(52) U.S. Cl.

CPC . *F02P 3/04* (2013.01); *F02P 13/00* (2013.01); *F02P 15/00* (2013.01); *F02P 15/10* (2013.01)

USPC ..... 123/621

(58) Field of Classification Search

CPC ..... F02P 3/04; F02P 13/00; F02P 15/00; F02P 15/10

USPC ..... 123/621, 622, 605, 643, 644, 623, 650, 123/594

See application file for complete search history.

(56) References Cited

U.S. PATENT DOCUMENTS

| | | | | |
|---|---|---|---|---|
| 4,170,208 | A * | 10/1979 | Katsumata et al. | 123/643 |
| 4,502,454 | A * | 3/1985 | Hamai et al. | 123/634 |
| 4,674,467 | A | 6/1987 | Tokura et al. | |
| 4,998,526 | A | 3/1991 | Gokhale | |
| 5,097,815 | A | 3/1992 | Oota et al. | |
| 5,193,515 | A * | 3/1993 | Oota et al. | 123/637 |
| 5,284,124 | A * | 2/1994 | Moriyama et al. | 123/643 |
| 7,404,396 | B2 * | 7/2008 | Toriyama et al. | 123/598 |

FOREIGN PATENT DOCUMENTS

| | | | |
|---|---|---|---|
| DE | 28 21 084 | A1 | 11/1979 |
| DE | 42 26 248 | A1 | 2/1994 |
| EP | 0 329 099 | A1 | 8/1989 |
| EP | 2 325 476 | A1 | 5/2011 |
| JP | 60-50273 | A | 3/1985 |
| JP | 3-121273 | A | 5/1991 |
| JP | 2002-221137 | A | 8/2002 |

OTHER PUBLICATIONS

Extended European Search Report dated Dec. 5, 2011.

* cited by examiner

*Primary Examiner* — Hieu T Vo

(74) *Attorney, Agent, or Firm* — McGinn IP Law Group, PLLC

(57) ABSTRACT

According to one embodiment, an internal combustion engine ignition system, including: a plurality of spark coils each having a primary coil and a secondary coil, each secondary coil being coupled to a common spark plug to apply a high voltage thereto; a plurality of primary current generation module provided correspondingly with the spark coils and configured to asynchronously generate primary currents respectively flowing through the primary coils; one or a plurality of primary current detection module configured to detect each of the primary currents; and a primary current control module configured to adjust an output power supplied to each primary coil in accordance with a change in the primary current to thereby control an increase rate of the primary current.

13 Claims, 23 Drawing Sheets

INTERNAL COMBUSTION ENGINE CONTROL SYSTEM

CROSS-REFERENCE TO RELATED APPLICATION(S)

This application claims priorities from Japanese Patent Application No. 2010-164927 filed on Jul. 22, 2010, and from Japanese Patent Application No. 2010-193133 filed on Aug. 31, 2010, the entire contents of which are incorporated herein by reference.

FIELD

Embodiments described herein relate generally to an internal combustion engine ignition system, and in particular relates to an ignition system capable of maintaining a discharge at a spark plug for a given period of time.

BACKGROUND

In recent years, in order to improve fuel efficiency for an internal combustion engine in a car, studies have been pursued on techniques related to lean fuel combustion control (lean burn engine) or EGR for flowing a combustion gas back to an engine cylinder. In such techniques, it is required to extend an energy discharge time of a spark plug so as to effectively combust a fossil fuel contained in a fuel air mixture. To attain this, a recent internal combustion engine ignition system (ignition system) is controlled such that a voltage is continuously applied to the spark plug to thereby maintain discharge in a plug gap.

For example, JP-2002-221137-A discloses an internal combustion engine ignition device (ignition device) employing the above-described technique. This ignition device includes: a first spark coil; a second spark coil; a first switching element for controlling a primary current flowing through the first spark coil; a second switching element for controlling the primary current flowing through the second spark coil; and a flip-flop circuit for switching ON/OFF timing of the first and second switching elements in a reciprocal manner. And, a single common spark plug is connected to an output end of the first spark coil and an output end of the second spark coil. A signal line of an ECU (Engine Control Unit) is connected to a signal input terminal of the flip-flop circuit, and a spark signal Sig is fed from this ECU as necessary.

It is assumed that signals outputted from the flip-flop circuit include a spark signal Siga for driving the first switching element and a second spark signal Sigb for driving the second switching element. A current flowing through a primary coil side of the first spark coil is defined as a primary current Ia1, while a current generated at a secondary coil side of the first spark coil in response to an instantaneous interruption of the primary current Ia1 is defined as a secondary current Ia2. Similarly, a current flowing through a primary coil side of the second spark coil is defined as a primary current Ib1, while a current generated at a secondary coil side of the second spark coil in response to an instantaneous interruption of this primary current Ib1 is defined as a secondary current Ib2. And, a current generated at the spark plug is defined as a discharge current I2.

FIG. 18 is a timing chart illustrating states of the above-mentioned signals. First, the ECU outputs the spark signal Sig for a given period of time. An output period of this spark signal Sig is set based on an operating state of an internal combustion engine. The output period of the spark signal Sig may also be referred to as a "spark request period".

Upon input of the spark signal Sig indicative of a discharge request period, the flip-flop circuit outputs the first and second spark signals Siga and Sigb during this discharge request period. These first and second spark signals Siga and Sigb are alternately outputted such that rising/falling timing thereof are different from each other (in particular, the spark signals subsequent to the initial spark signals will be outputted in a reciprocal manner).

The primary current Ia1 flowing through the first spark coil is intermittently generated based on the rectangular-wave first spark signal Siga during the rising period of the spark signal Sig. This primary current Ia1 is controlled so as to reach a previously-set threshold I1*th*.

By instantaneously interrupting the primary current Ia1, an induced electromotive force is produced at the secondary side of the first spark coil, and the secondary current Ia2 flows therethrough as illustrated in FIG. 18.

On the other hand, the primary current Ib1 flowing through the second spark coil is also intermittently generated based on the rectangular-wave second spark signal Sigb during the rising period of the spark signal Sig. This primary current Ib1 is also controlled so as to reach a previously-set threshold I1*th*. This threshold I1*th* is the same as that for the primary current flowing through the first spark coil.

By instantaneously interrupting the primary current Ib1, an induced electromotive force is produced at the secondary side of the second spark coil, and the secondary current Ib2 flows therethrough.

Both of the induced electromotive forces generated at the first and second spark coils will be applied to the spark plug. Thus, the discharge current I2 of the spark plug has a waveform in which waveforms of the secondary current Ia2 and the secondary current 1*b*2 illustrated in FIG. 18 are combined.

For the discharge current I2, a discharge current threshold I2*th* is defined as illustrated in FIG. 18. The threshold I2*th* is defined such that, when the discharge current I2 falls below the threshold I2*th*, the flow of the discharge current I2 is likely to be interrupted (this interruption may hereinafter be referred to as a "discharge interruption"). Thus, the threshold I2*th* is a reference value for determining whether or not a discharge current can be maintained during the rising period of the spark signal Sig.

Accordingly, the primary current threshold I1*th* is set so that the discharge current I2 will not fall below the discharge current threshold I2*th*. Further, the primary currents Ia1 and Ib1 are each controlled so as to reach the primary current threshold I1*th*; thus, the discharge current I2 will be controlled so as not to fall below the discharge current threshold I2*th*, and the discharge current I2 will be maintained during the rising period of the spark signal Sig.

In JP-2002-221137-A, a car-mounted battery is connected to the primary coils of both of the first and second spark coils, and the respective primary currents are generated by controlling the two switching elements. In JP-2002-221137-A, depending on an output state of the car-mounted battery, the switching timing (e.g., t1, t2, t3, between the two switching elements may be made faster such that the primary current Ia1 or Ib1 does not reach the primary current threshold I1*th*, as illustrated in (a) and (b) of FIG. 19. In this case, the induced electromotive forces produced at the secondary coils of both of the first and second spark coils become insufficient, and therefore, the discharge current I2 partially falls below the discharge current threshold I2*th* as illustrated in (c) of FIG. 19.

Thus, as illustrated in (d) of FIG. 19, a discharge interruption Br might be caused within a range in which the discharge current I2 falls below the threshold I2*th*, and the discharge of the spark plug cannot be maintained during the rising period of the spark signal Sig.

JP-H03-121273-A discloses an ignition device that controls energization times of switching elements provided for primary coils. This ignition device additionally includes: a circuit for detecting a primary current Ia1 flowing through a first spark coil; a circuit for detecting a primary current Ib1 flowing through a second spark coil; and a circuit for obtaining a current integral value INTa and a current integral value INTb by integrating the primary current Ia1 or the primary current Ib1. A threshold TH is set for the integral value based on a given condition (see (c) of FIG. 20). When the current integral value INTa reaches the threshold TH, the calculation of the current integral value INTa is stopped, and the calculation of the current integral value INTb is started. Then, when the current integral value INTb reaches the threshold TH, the calculation of the current integral value INTb is stopped, and the calculation of the current integral value INTa is restarted. In this manner, both of the integral values are alternately calculated.

The switching element corresponding to the first spark coil is energized for a time period from when an integration of the primary current Ia1 is started to when the integral value reaches the threshold TH (see (a) of FIG. 20). Similarly, the switching element corresponding to the second spark coil is energized for a time period set based on the integral value of the primary current Ib1 (see (b) of FIG. 20).

In this case, as long as primary current interruption timing comes at approximately regular intervals (see (c) of FIG. 20), the discharge current I2 exhibits a stable sawtooth waveform as illustrated in (d) of FIG. 20, thereby maintaining a suitable state in which the discharge current I2 exceeds the discharge current threshold I2*th*.

The technique in JP-H03-121273-A is to adjust the energization time of each switching element based on a comparison result between the current integral value and the threshold. The technique may be modified to adjust the energization time of each switching element based on a comparison result between the instant current value of the primary coil and the threshold TH. This technique is hereinafter referred to as a "modified technique".

In this modified technique, the switching timing (e.g., t1, t2, t3, . . . ) of both of the switching elements is previously set as illustrated in (a) to (c) of FIG. 21, and the threshold I1*th* is set for each of the primary currents Ia1 and Ib1. When the primary current Ia1 cannot reach the threshold I1*th* at the switching timing t1, the energization time of the corresponding one of the switching elements is extended until the primary current Ia1 reaches the threshold I1*th* (the extended time in this case is denoted by Δt1). Similarly, when the primary current Ib1 cannot reach the threshold I1*th* at the next switching timing t2, the energization time of the other switching element is extended until the primary current Ib1 reaches the threshold I1*th* (the extended time in this case is denoted by Δt2).

In the modified technique, the energization time of each switching element is extended as necessary. Therefore, as in the technique of JP-H03-121273-A, as long as primary current interruption timing comes at approximately regular intervals, the discharge current I2 of a high level and of a stable sawtooth waveform can be obtained, and the discharge current I2 will not fall below the threshold I2*th* during the rising period of the spark signal Sig, thereby maintaining a suitable state in which no discharge interruption occurs.

However, sometimes, the spark coils or engine cylinders may inherently have an individual performance difference therebetween. In this case, in the technique of JP-H03-121273-A or in the modified technique, the energization time of only one of the spark coils may be extended (see (a) and (b) of FIG. 22). When the energization times of the switching elements are unbalanced, primary current interruption timing comes at irregular intervals as illustrated in (c) of FIG. 22 such that the interruption timing is shifted forward or backward. Accordingly, the waveform of the discharge current I2 becomes irregular, and the discharge current I2 may fall below the threshold I2*th* at a section where the interruption timing is shifted backward. Hence, as illustrated in (d) of FIG. 22, the discharge interruption Br may be caused.

Furthermore, it is known that when the internal combustion engine is operated in a high load state, the discharge current I2 steeply drops. In this case, even if the primary current threshold I1*th* is normally set, the discharge current I2 falls below the threshold I2*th* (see (c) of FIG. 23), and the discharge interruption Br is caused (see (d) of FIG. 23). Moreover, when a spark plug is significantly degraded due to, for example, the continuation of a situation accompanied by smoldering, carbon is accumulated around an insulator, thereby steeply reducing the discharge current I2 and causing the discharge interruption Br.

SUMMARY

One object of the present invention is to provide an internal combustion engine control system capable of keeping a discharge current at a high level under any condition, and maintaining a discharge state during a discharge request period.

According to one aspect of the present invention, there is provided an internal combustion engine ignition system, including: a plurality of spark coils each having a primary coil and a secondary coil, each secondary coil being coupled to a common spark plug to apply a high voltage thereto; a plurality of primary current generation module provided correspondingly with the spark coils and configured to asynchronously generate primary currents respectively flowing through the primary coils; one or a plurality of primary current detection module configured to detect each of the primary currents; and a primary current control module configured to adjust an output power supplied to each primary coil in accordance with a change in the primary current to thereby control an increase rate of the primary current.

According to another aspect of the present invention, there is provided an internal combustion engine ignition system, including: a plurality of spark coils each having a primary coil and a secondary coil, each secondary coil being coupled to a common spark plug to apply a high voltage thereto; a plurality of primary current generation module provided correspondingly with the spark coils and configured to asynchronously generate primary currents respectively flowing through the primary coils; one or a plurality of secondary current detection module configured to detect each of secondary currents respectively flowing through the secondary coils; and a primary current control module configured to adjust an output power supplied to each primary coil in accordance with a change in the secondary current to thereby control an increase rate of the primary current.

In an ignition system according to the present invention, a primary current is adjusted to reach a threshold at the switching timing of switching elements. Therefore, the turning-off timing of the primary current synchronously comes with the switching timing of the switching elements, and thus comes at approximately regular intervals. Consequently, a discharge current is maintained at a value higher than a discharge current threshold while exhibiting a stable sawtooth waveform, thus a stable discharge state in which substantially no discharge interruption occurs can be maintained.

Further, by predicting a change in the discharge current based on the operating state of an internal combustion engine, and by controlling a DC-DC converter based on the predicted change in the discharge current, a stable discharge state in which no discharge interruption occurs can be more reliably maintained.

EMBODIMENTS

Figure 1:
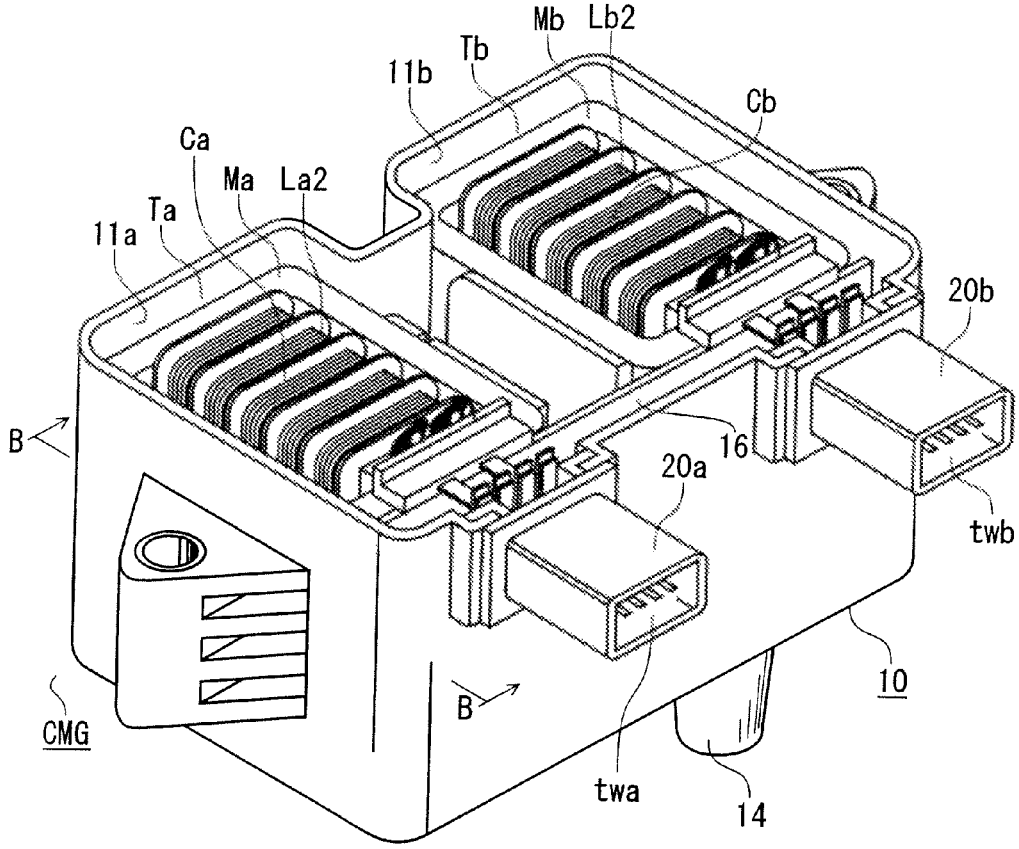
FIG. 1 illustrates a structure of an ignition device according to embodiments.
Figure 2:
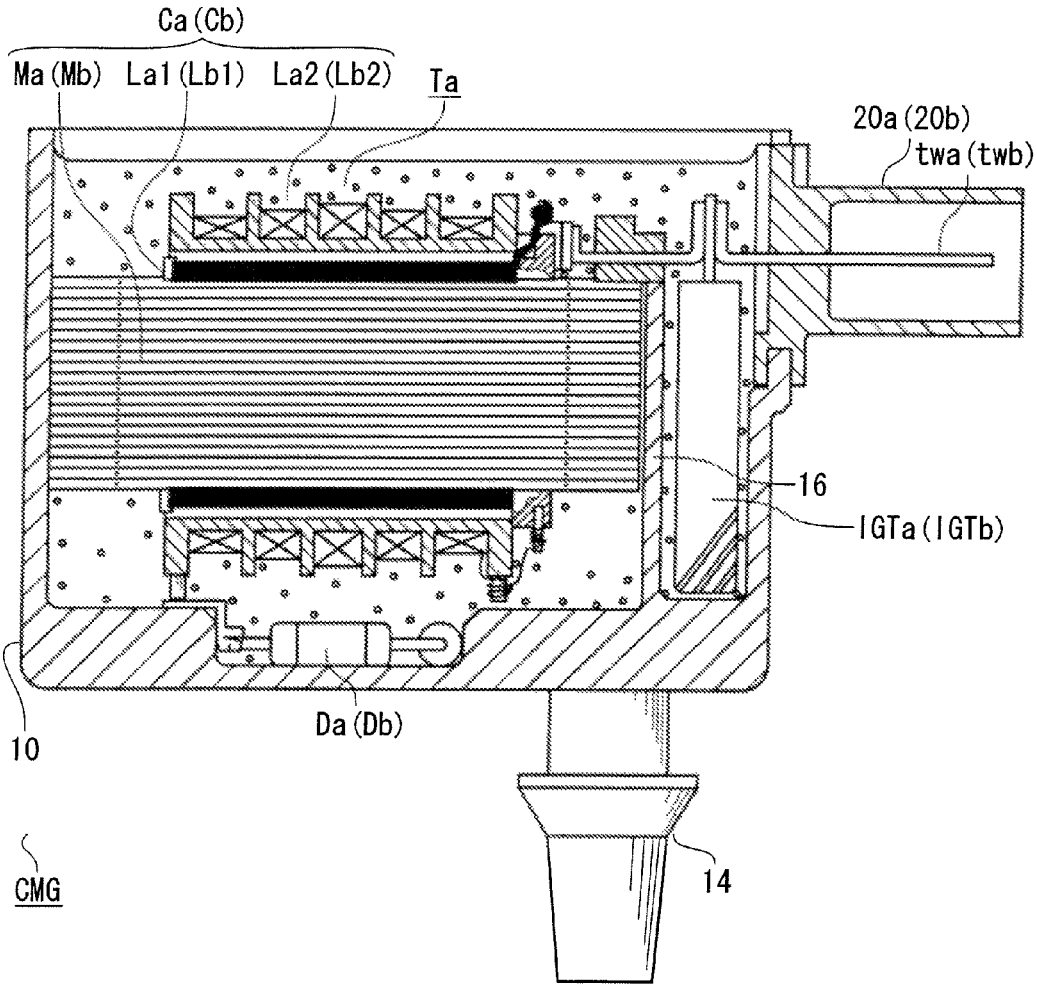
FIG. 2 is a cross-sectional view taken along the line B-B of the ignition device according to the embodiments.

Hereinafter, embodiments will be described with reference to the drawings. As illustrated in FIGS. 1 and 2, an internal combustion engine ignition device (ignition device) CMG includes: spark coils Ca and Cb; igniters IGTa and IGTb (i.e., primary current generation module); and a case body 10.

The spark coil Ca (Cb) includes a primary coil La1 (Lb1), a secondary coil La2 (Lb2) and an iron core Ma (Mb). In the ignition device CMG according to the embodiments, the single case body 10 accommodates plural spark coils.

The igniters IGTa and IGTb are provided correspondingly with the spark coils Ca and Cb. Thus, plural igniters are provided in accordance with the number of the spark coils.

The case body 10 is formed of a material such as a thermoplastic resin to thereby ensure insulation around the spark coils. In the case body 10, a first accommodation part 11*a*, a second accommodation part 11*b* and a partition wall 16 are formed, and the spark coils Ca and Cb are contained in the accommodation parts 11*a* and 11*b*, respectively. The igniters IGTa and IGTb are contained in a narrow space defined by the partition wall 16. Connectors 20*a* and 20*b* are attached to the case body 10, and plural terminals twa and twb provided therein are appropriately connected to igniter terminals and spark coil terminals.

Gaps in the ignition device CMG are filled with the thermoplastic resin as illustrated in FIG. 2 to thereby maintain the insulation around the coils. The ignition device CMG includes a high voltage terminal within a high voltage part 14, so that upon input of spark signals to the connector terminals twa and twb, electric power supplied from a DC-DC converter (described later) is increased in voltage, and the resulting voltage is applied to a spark plug at a subsequent stage.

Embodiment 1

Figure 3:
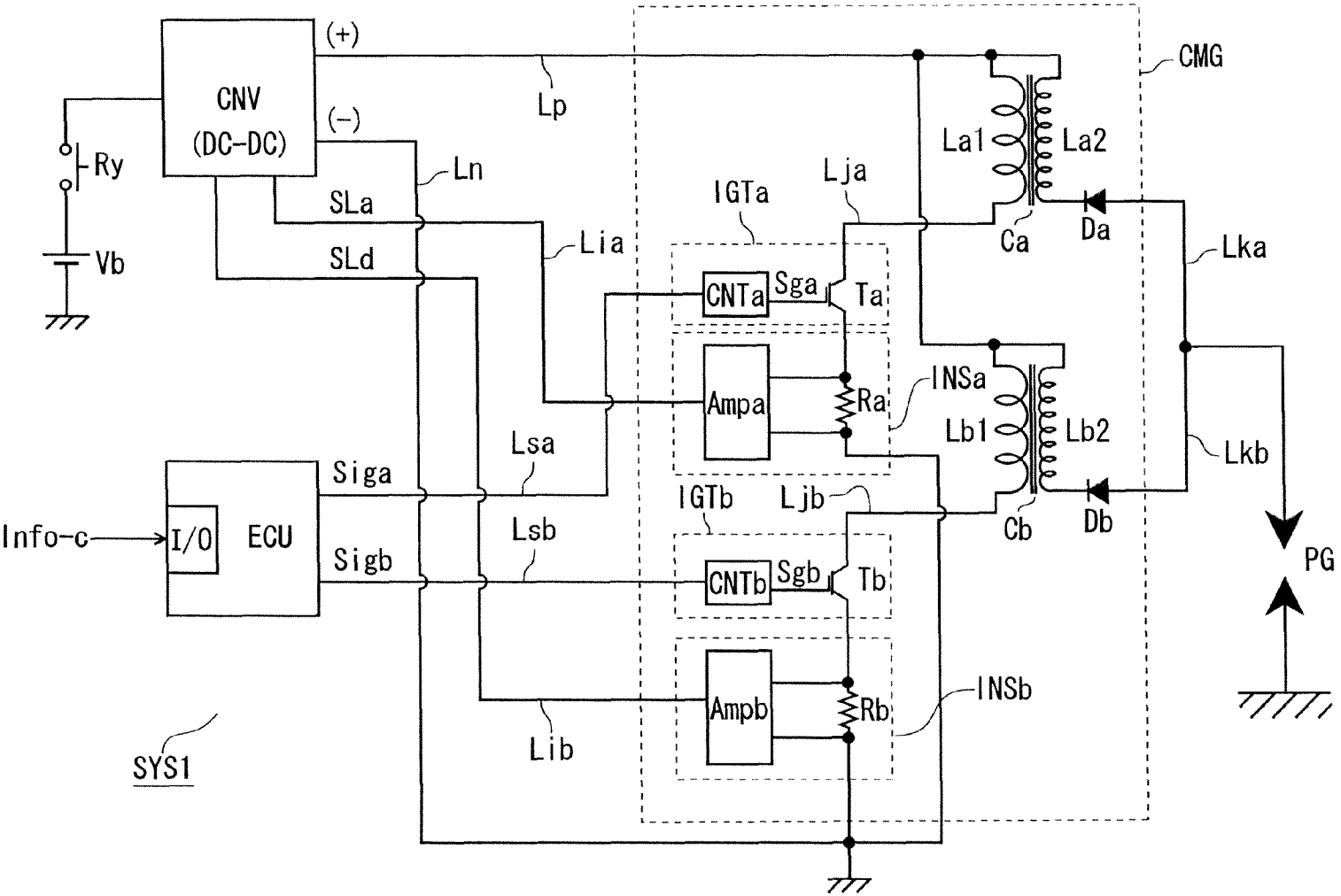
FIG. 3 illustrates a circuit configuration of an ignition system according to Embodiment 1.

FIG. 3 illustrates a configuration of an internal combustion engine ignition system (ignition system) SYS1 according to Embodiment 1. The ignition system SYS1 includes: the above-mentioned ignition device CMG; and a DC-DC converter CNV (i.e., a primary current control module).

The ignition device CMG is equipped with a power line Lp through which electric power is received from the DC-DC converter CNV, and the power line Lp is connected to input ends of both of primary coils La1 and Lb1 of the spark coils. Further, the other end of the primary coil La1 is connected with another power line Lja, and is grounded to a ground potential via a switching element Ta and a resistor Ra. Furthermore, the other primary coil Lb1 is also wired in a similar manner. Moreover, a diode Da is connected to an output end of the secondary coil La2 in a backward direction. This diode Da is provided in order to prevent preignition. Similarly, a diode Db is also connected to an output end of a secondary coil Lb2. Power lines Lka and Lkb are respectively connected to the diodes Da and Db, and a contact point between the power lines Lka and Lkb is connected to an input terminal of a spark plug PG. That, the secondary coils La2 and Lb2 are commonly connected to the single spark plug, and a negative high voltage will be applied to the spark plug PG from both of the spark coils.

The igniter IGTa incorporates a control part CNTa and the switching element Ta. The control part CNTa is connected with a signal line Lsa extended from an engine control unit ECU, and is fed a spark signal Siga. The spark signal Siga may have a signal waveform in which a rising time indicative of a discharge request period is long, or may have a multi-spark signal waveform in which plural pulses are formed within a discharge request period. In the former case, the spark signal Siga may be converted into a multi-spark signal waveform by the control part CNTa. In either case, the switching element Ta is ON/OFF controlled plural times within a discharge request period, and therefore, a primary current flowing through the primary coil La1 will be generated intermittently. Hereinafter, signals applied from the control parts CNTa and CNTb to input terminals of the switching elements Ta, Tb will be referred to "gate signal Sga" and "gate signal Sgb", respectively. A power transistor such as an IGBT or a MOSFET may be used as the switch element.

A primary current detection circuit INSa (i.e., a primary current detection module) includes a shunt resistor Ra and a sensor circuit Ampa. FIG. 3 illustrates an example in which the primary current detection circuit INSa is provided separately from the igniter IGTa. However, the embodiment is not limited thereto, and the primary current detection circuit INSa may be incorporated into the igniter IGTa as a part thereof. For example, the igniter IGTa illustrated in FIG. 2 incorporates the primary current detection circuit INSa as a part thereof. The sensor circuit Ampa is fed power through an unillustrated circuit configuration, and proportionally amplifies a fed signal. In this embodiment, voltages at both ends of the shunt resistor Ra which depend on the primary current are applied to input terminals of the sensor circuit Ampa, and the sensor circuit Ampa outputs a signal (current detection signal) SLa proportional to the voltages. Thus, the primary current detection circuit INSa detects the primary current flowing through the primary coil La1 or the switching element Ta. An operational amplifier or the like is used as the sensor circuit Ampa. Instead of the shunt resistor Ra, a sensor circuit including a coil or the like may alternatively be used. A primary current detection circuit INSb has a circuit configuration similar to that of the primary current detection circuit INSa. That is, the primary current detection circuit INSb includes a shunt resistor Rb and a sensor circuit Ampb. Besides, in this embodiment, the primary current detection module includes both of the primary current detection circuit INSa and the primary current detection circuit INSb.

Similarly to the igniter IGTa, the igniter IGTb incorporates the control part CNTa to which a spark signal Sigb is fed through a signal line Lsb extended from the engine control unit ECU. Here, the gate signal Sgb supplied to a switching element Tb is generated in an asynchronous manner with respect to the gate signal Sga supplied to the switching element Ta. For example, the signals Sga and Sgb may be alternately/reciprocally outputted. Hence, the primary current flowing through a power line Ljb is generated asynchronously with respect to the primary current flowing through the power line Lja.

The engine control unit ECU includes a CPU, an I/O circuit, a memory circuit, a clock circuit, etc., and outputs the first and second spark signals Siga and Sigb based on inputted information to thereby appropriately control an internal combustion engine. The I/O circuit is fed information (operating state information) Info-c concerning an operating state of the internal combustion engine as appropriate from various electronic control units or sensors provided at respective parts of a car. This operating state information Info-c includes operation information of an injector, information provided from a crank angle sensor, etc., and the engine control unit ECU recognizes the load state of the internal combustion engine and the number of revolutions thereof based on these information. Further, the engine control unit ECU sets the respective spark signals Siga and Sigb based on these information. In this embodiment, the engine control unit ECU carries out control so that the second spark signal Sigb has the waveform rising simultaneously with the falling of the first spark signal Siga, and the second spark signal Sigb has the wave form falling simultaneously with the rising of the first spark signal Siga. Accordingly, in the primary currents flowing through both of the spark coils, the waveforms of the respective currents will appear in an intermittent and reciprocal manner.

As illustrated in FIG. 3, a voltage of about 12 (V) to 24 (V) is applied to the DC-DC converter CNV from a car-mounted battery Vb, and the DC-DC converter CNV generates output power based on the applied voltage. In this embodiment, a car power system includes a relay Ry between the car-mounted battery Vb and the DC-DC converter CNV. The relay Ry is driven to supply the voltage of the car-mounted battery Vb to the DC-DC converter CNV after the checking is performed by a given control unit provided in the car. The power line Lp is connected to an anode output terminal (+) of the DC-DC converter CNV, while a power line Ln is connected to a cathode output terminal (−) of the DC-DC converter CNV. The power line Lp is connected to the input side of the primary coil La1 and the input side of the primary coil Lb1. Thus, the DC-DC converter CNV supplies the output power to the spark coils Ca and Cb via the common power line. The primary current detection circuits INSa and INSb respectively output the primary current detection signals SLa and SLb, and the detection signals SLa and SLb are fed to the DC-DC converter CNV respectively through signal lines Lia and Lib.

A circuit configuration of the DC-DC converter CNV will be described below with reference to FIG. 4. While an example circuit configuration of a DC-DC converter is illustrated, the "primary current control module" should not be limited thereto.

The DC-DC converter CNV includes: a full-bridge circuit Fb consists of bridge-connected power transistors T1 to T4; an isolation transformer Tc connected at a subsequent stage of the full-bridge circuit Fb; a rectifier circuit Rc consists of bridge-connected diodes; a smoothing circuit Co connected at a subsequent stage of the rectifier circuit Rc; and a control circuit CNTc for supplying driving signals St1 to St4 to the power transistors T1 to T4, respectively.

Figure 4:
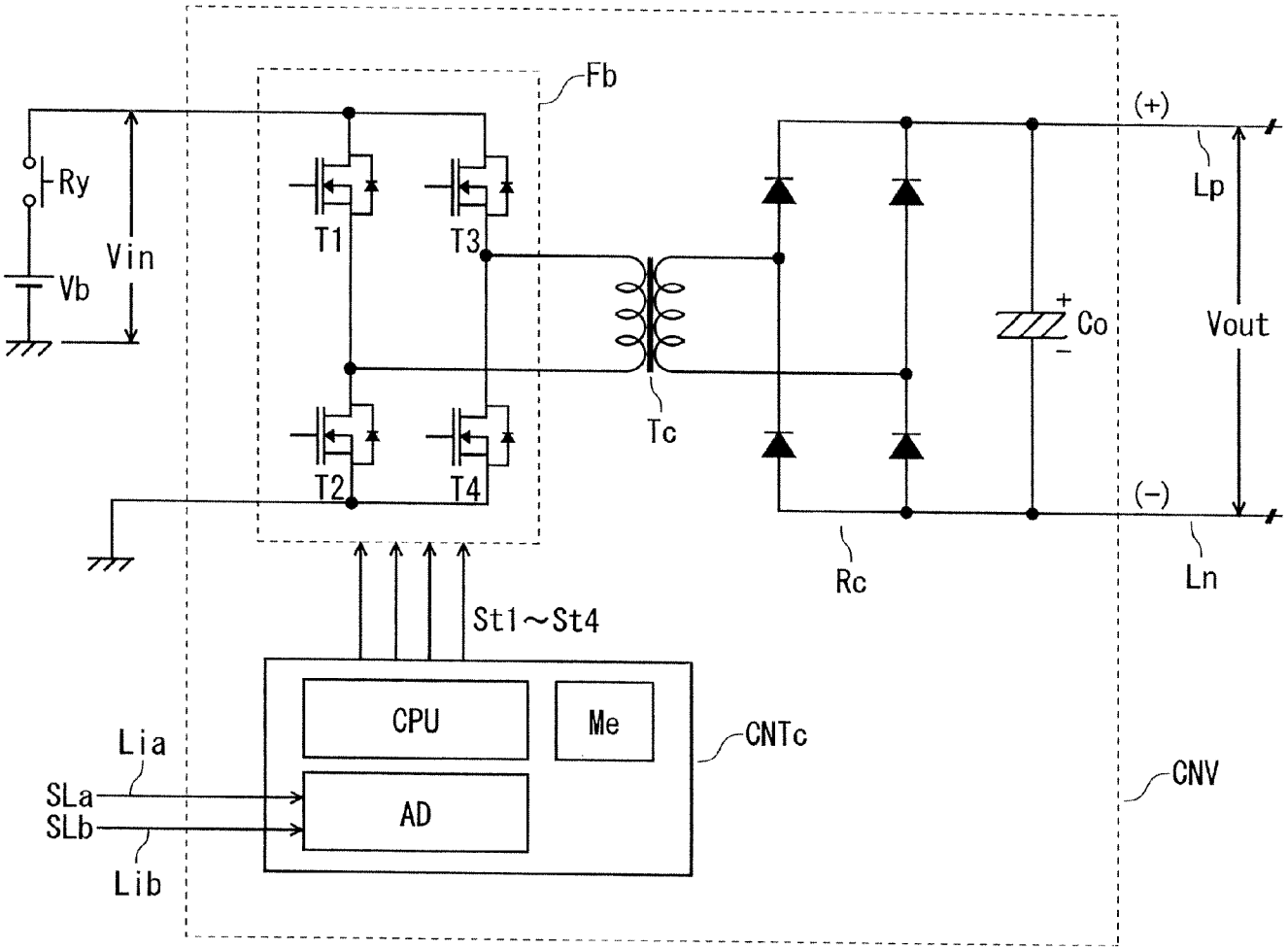
FIG. 4 illustrates a circuit configuration of a DC-DC converter according to Embodiment 1.

The control circuit CNTc includes an arithmetic circuit CPU, a signal conversion circuit AD and a memory circuit Me as illustrated in FIG. 4, and also includes a clock circuit or the like in addition to these circuits. Further, upon input of the primary current detection signals SLa and SLb to input ports of the control circuit CNTc, the signal conversion circuit AD performs A/D conversion on these signals SLa and SLb, and the A/D converted information (primary current information) Ik1 is stored in the memory circuit Me as necessary.

In the memory circuit Me, a threshold I1*th* is stored, and information on the driving signals St1 to St4 for allowing the primary current to reach the threshold I1*th* is mapped. The threshold I1*th* is set to realize a discharge current I2 of the spark coil which is equal to or higher than a threshold I2*th* and to thereby maintain the discharge at the spark plug during the discharge request period. In the mapped information, information on the driving signals St1 to St4 is given for various kinds of primary current information. The information on the driving signals St1 to St4 is set so that the primary current reaches the threshold I1*th* within a period (switching period) To during which switching between the switching elements Ta and Tb is performed. The information on the driving signals St1 to St4 may be obtained experimentally in advance. In accordance with the primary current information Ik1, the memory circuit Me provides suitable information on the driving signals St1 to St4 selected from the stored information to the arithmetic circuit CPU with.

In this embodiment, the DC-DC converter CNV controls the primary current flowing through the primary coil La1 or Lb1, in response to the primary current detection signal SLa or SLb, as follows: First, as illustrated in (a) of FIG. 5, when the primary current of the spark coil is equal to the threshold I1*th*, the control circuit CNTc recognizes this fact through the primary current detection signal SLa or SLb, selects the previous driving signals St1 to St4 so as to maintain this state, and drives the full-bridge circuit Fb based on this selection, thereby keeping an output voltage Vout constant.

Figure 5:
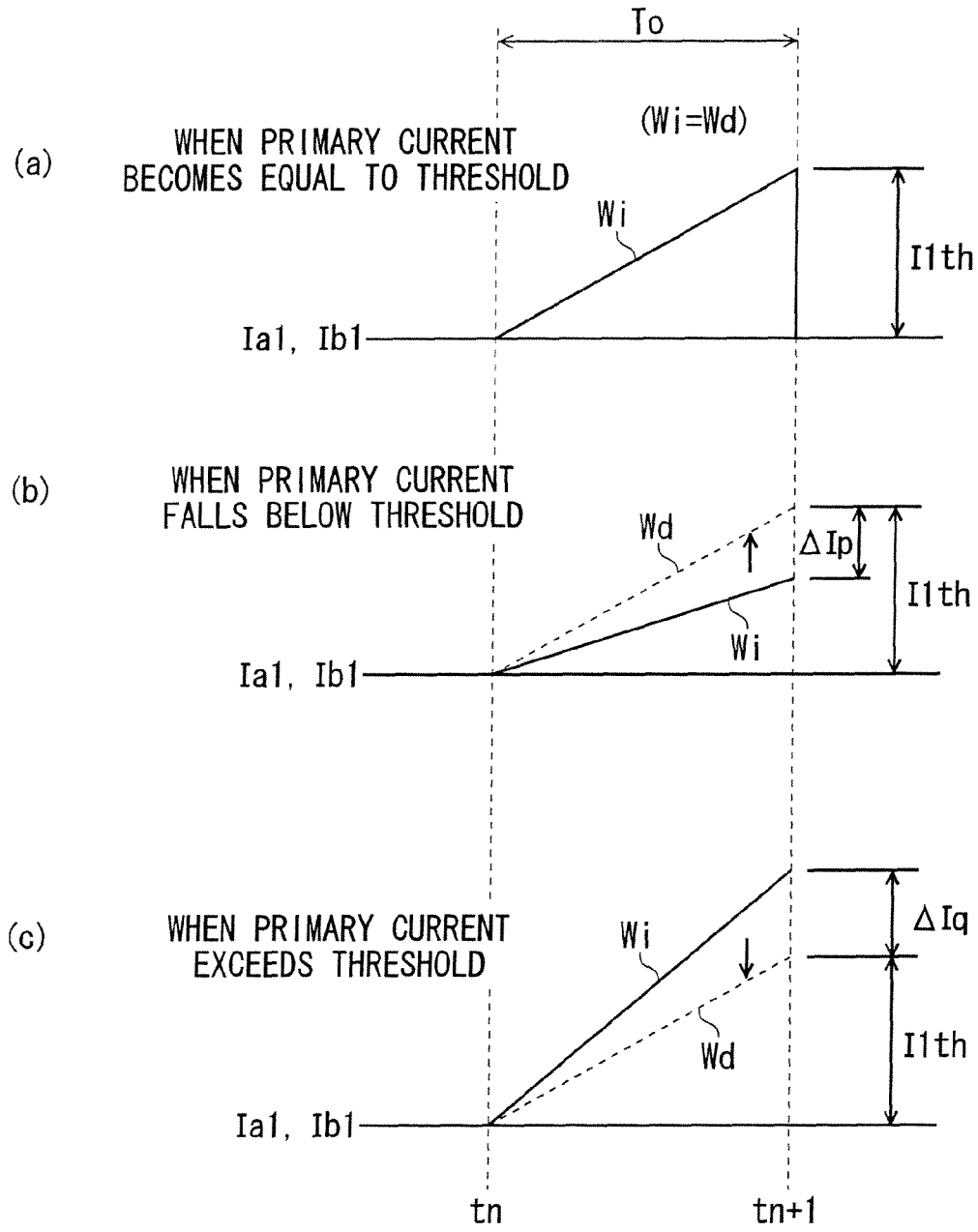
FIG. 5 illustrates an output current of the DC-DC converter.

(b) of FIG. 5 illustrates a case where the primary current of the spark coil is lower than the threshold I1*th*. If the output voltage Vout is maintained, the shortage state in which the primary current at a lapse of the switching period To falls short of the threshold I1*th* by ΔIp is continued as illustrated in (b) of FIG. 5. Thus, the DC-DC converter CNV reselects the driving signals St1 to St4 based on the primary current so as to increase the output voltage Vout to a desired value. As a result, the inclination of a waveform Wi (i.e., an increase rate) of the primary current is increased, and the primary current will reach the threshold I1*th* at the lapse of the switching period To.

(c) of FIG. 5 illustrates a case where the primary current of the spark coil is higher than the threshold I1*th*. If the output voltage Vout is maintained, the excess state in which the primary current at a lapse of the switching period To exceeds the threshold I1*th* by ΔIq is continued as illustrated in (c) of FIG. 5. Thus, the DC-DC converter CNV reselects the driving signals St1 to St4 based on the primary current so as to reduce the output voltage Vout to a desired value. As a result, the inclination of the waveform Wi (i.e., an increase rate) of the primary current is reduced, and the primary current will reach the threshold I1*th* at the lapse of the switching period To.

That is, the DC-DC converter CNV adjusts the output power to be supplied to each primary coil in accordance with a change in the primary current. In this Embodiment, the DC-DC converter CNV controls an increase rate of the primary current to reach the threshold I1*th* at the end of the switching period To.

In (a) to (c) of FIG. 5, a starting point tn of the switching period To corresponds to an ending point of the previous switching period, and an ending point tn+1 of the switching period To corresponds to a starting point of the next switching period. Further, each of the starting point tn and the ending point tn+1 may be referred to as the "switching timing" of the switching element.

Figure 6:
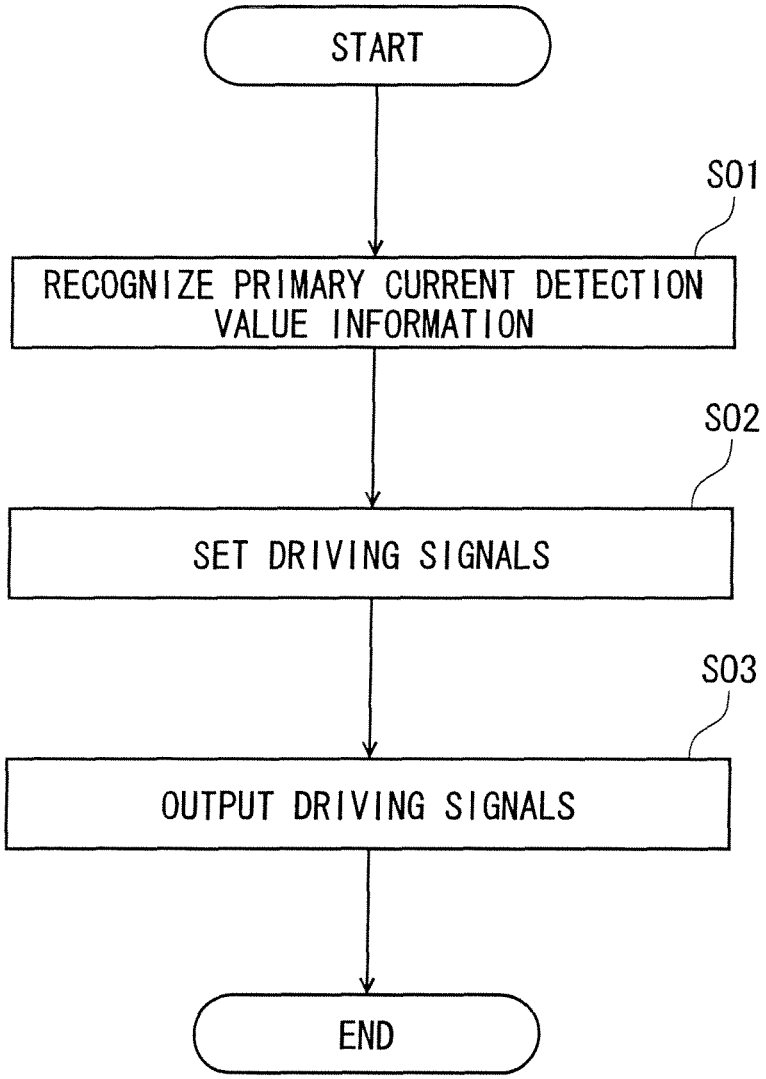
FIG. 6 is a flow chart for controlling an output current.

FIG. 6 is a flow chart of a control program incorporated into the memory circuit Me of the control circuit CNTc. Upon input of the primary current detection signal SLa or SLb, the control program performs processing using this signal as the primary current detection information Ik1 (S01).

Subsequently, in a driving signal setting step S02, driving signal information is extracted from mapped information based on the primary current detection information Ik1, and this driving signal information is given to the arithmetic circuit CPU. Then, in a driving signal output step S03, the driving signals St1 to St4 are generated based on this driving signal information, and the generated driving signals St1 to St4 are outputted, thereby driving the respective power transistors (switching elements) T1 to T4. Since these driving signals are appropriately set based on the primary current, the primary current will reach the threshold I1*th* with reliability at the end of the switching period To.

As described above, the ignition system SYS1 according to Embodiment 1 carries out control so that the primary current reaches the threshold I1*th* when the switching timing of the switching element comes.

Figure 7:
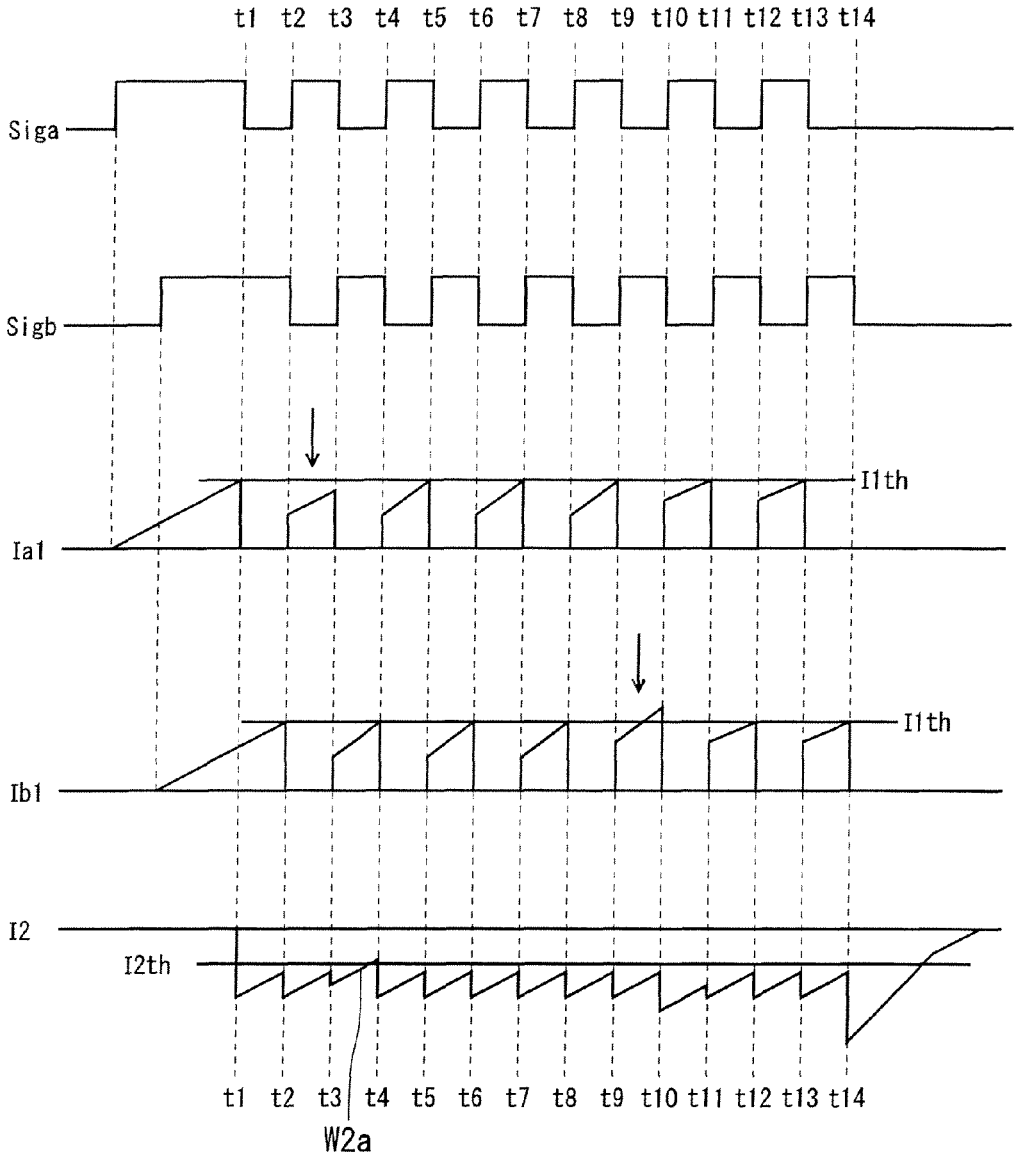
FIG. 7 is a timing chart illustrating spark signals, primary currents and a discharge current according to Embodiment 1 (first case).

Accordingly, when the waveform of the primary current is reduced at the switching timing t2 to t3 as illustrated in FIG. 7, the DC-DC converter CNV carries out control so that the inclination (i.e., an increase rate) of the primary current at the switching timing t3 to t4 is increased, and the primary current reaches the threshold I1*th* at the switching timing t4. A waveform W2*a* of the discharge current I2 is slightly reduced by increasing the primary current within the switching period in this manner, but the discharge current I2 is increased at the switching timing t4. Hence, the discharge current I2 is prevented from falling far below the discharge current threshold I2*th*, thus maintaining the discharge current I2 at a high level. Therefore, the discharge current I2 not only has its value kept at a high level but also exhibits a stable sawtooth waveform, thus maintaining a stable discharge state in which substantially no discharge interruption occurs.

In the ignition system SYS1 according to Embodiment 1, when the primary current largely exceeds the threshold I1*th* at the switching timing t9 to t10 as illustrated in FIG. 7, the DC-DC converter CNV detects such large primary current, and carries out control so that the primary current becomes substantially equal to the threshold I1*th* at the switching timing t11. Thus, the discharge current I2 is controlled so as to be equal to the threshold I2*th*, and a stable combustion operation can be continuously realized in the internal combustion engine.

Figure 8:
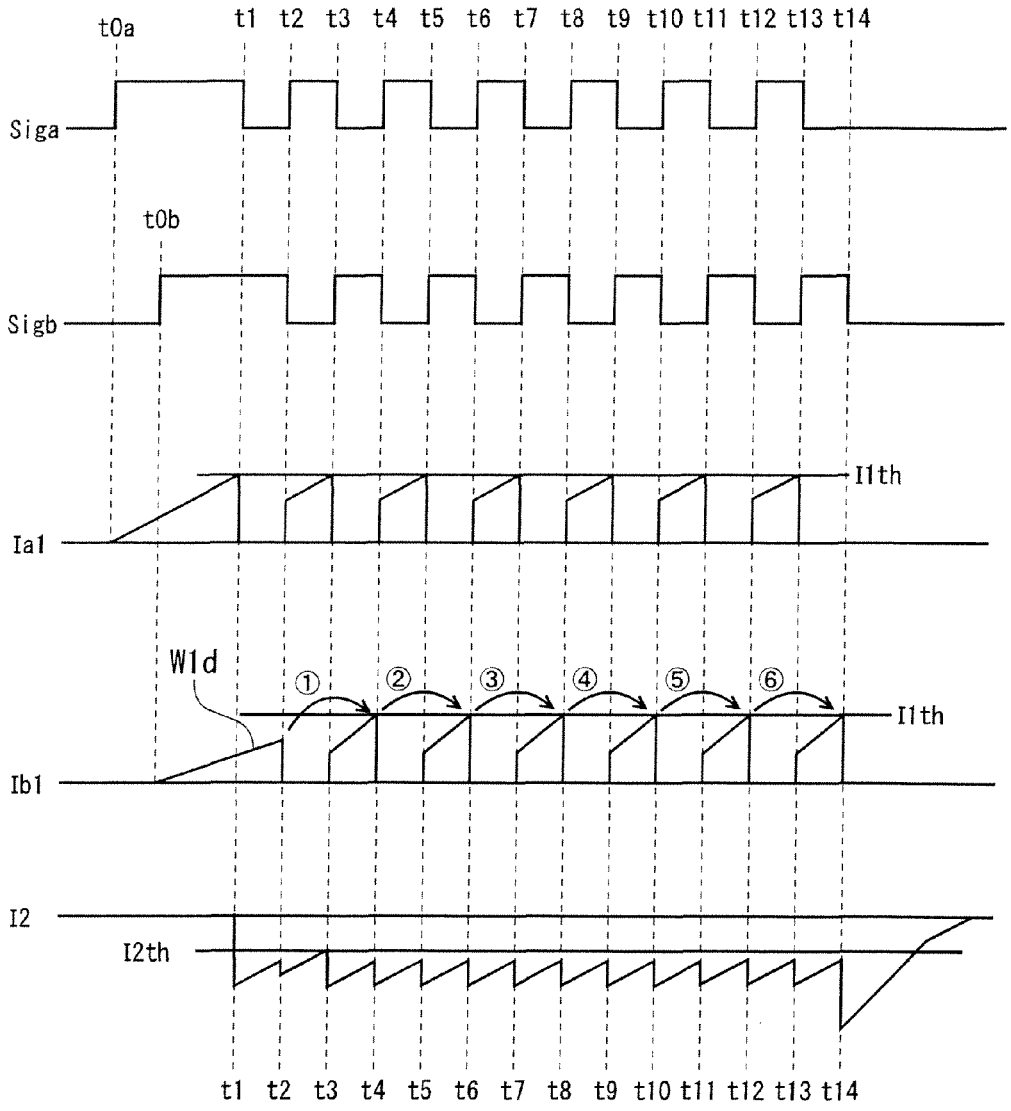
FIG. 8 is a timing chart illustrating spark signals, primary currents and a discharge current according to Embodiment 1 (second case).

FIG. 8 illustrates a case where output performance of the spark coil Ca and that of the spark coil Cb are different. In such a case, in the DC-DC converter CNV, the full-bridge circuit Fb is driven individually for each of the primary current detection signals SLa and SLb. It is assumed that the spark coil Ca has the output performance as designed while the spark coil Cb has the output performance somewhat lower than the designed value.

In this case, the DC-DC converter CNV reflects the primary current detection signal SLa, detected at switching timing t0*a* to t1, in the control of the primary current at the switching timing t2 to t3, and reflects the primary current detection signal SLa, detected at the switching timing t2 to t3, in the control of the primary current at the switching timing t4 to t5, thus using the primary current detection signal SLa only for the control of the primary current of the spark coil Ca. On the other hand, the DC-DC converter CNV reflects the primary current detection signal SLb, detected at switching timing t0*b* to t2, in the control of the primary current at the switching timing t3 to t4, and reflects the primary current detection signal SLb, detected at the switching timing t3 to t4, in the control of the primary current at the switching timing t5 to t6, thus using the primary current detection signal SLb only for the control of the primary current of the spark coil Cb.

As a result, the primary current Ia1 of the primary coil La1 reaches the threshold I1*th* as illustrated in FIG. 8, and therefore, the DC-DC converter CNV maintains the output voltage Vout in its present state. On the other hand, the primary current Ib1 of the primary coil Lb1 does not reach the threshold I1*th* (see a waveform Wld), and therefore, the inclination of the primary current Ib1 is increased at the next switching timing t3 to t4 (see Control Step 1). Then, after Control Step 1, the DC-DC converter CNV carries out control for maintaining the primary current Ib1 at Control Step 2 and subsequent steps (i.e., Control Steps 2 to 6). That is, the DC-DC converter CNV alternately carries out control for keeping the primary current as it is for the primary coil La1, and control for raising and adjusting the primary current for the primary coil Lb1.

Even when the spark coils have different output characteristics, the primary currents Ia1 and Ib1 outputted from the spark coils are both controlled to reach the threshold I1*th* through the above-described control, thereby keeping the discharge current I2 at a suitable level and maintaining the discharge state.

Figure 9:
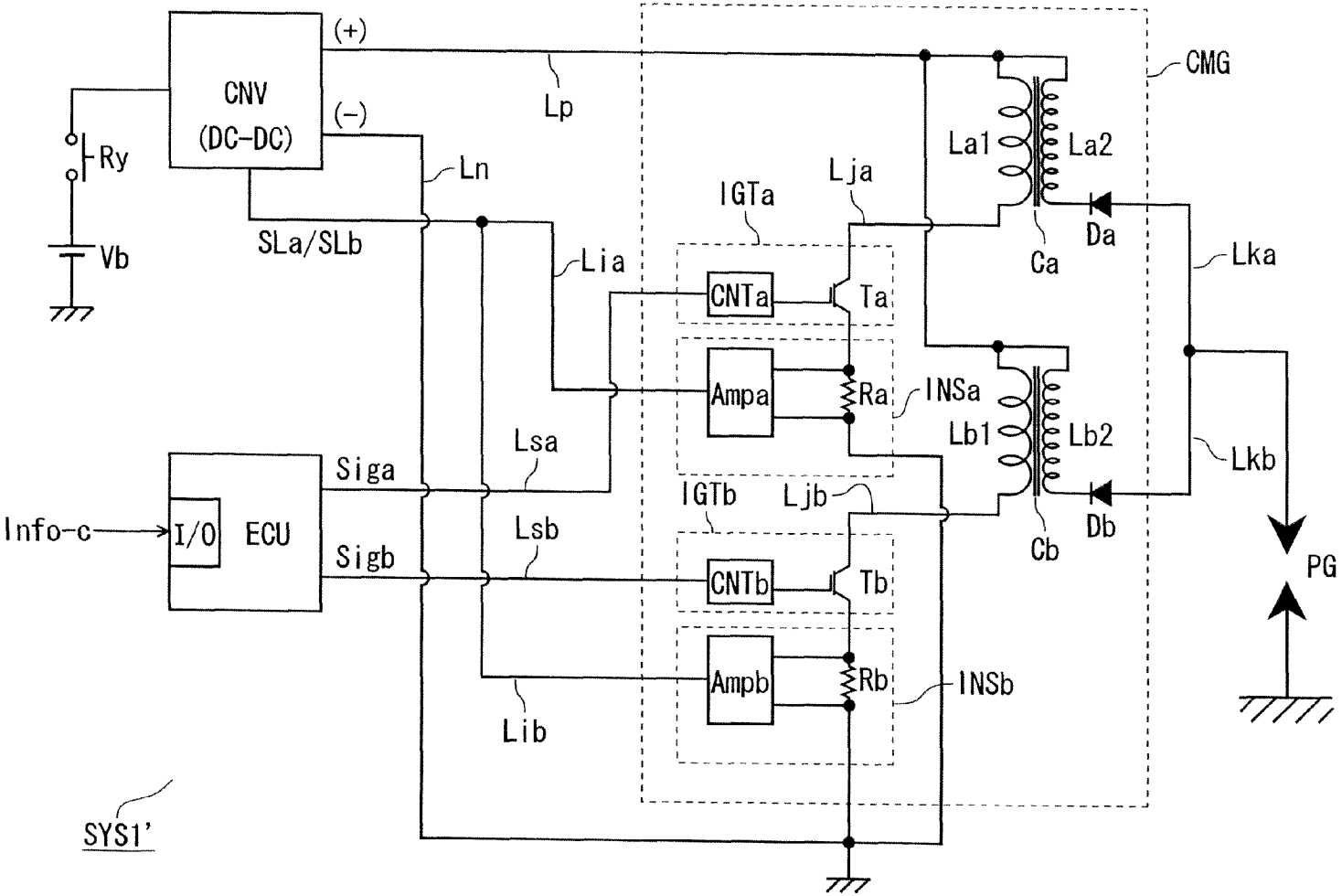
FIG. 9 illustrates a circuit configuration of an ignition system according to a variation of Embodiment 1.

FIG. 9 illustrates an ignition system according to a variation of Embodiment 1.

In the ignition system according to Embodiment 1 illustrated in FIGS. 3 and 4, the primary current detection signals SLa and SLb are respectively inputted to different A/D ports provided in the DC-DC converter CNV. On the other hand, in an ignition system SYS1' according to the variation of Embodiment 1 illustrated in FIG. 9, the primary current detection signals SLa and SLb is collectively inputted to a single A/D port through a common signal line. In this case, the DC-DC converter CNV may detect output timing of the spark signals Siga and Sigb outputted from the engine control unit ECU (no illustration is given on this detection) to thereby determine whether a detected signal is either the primary current detection signal SLa or the primary current detection signal SLb.

Embodiment 2

Figure 10:
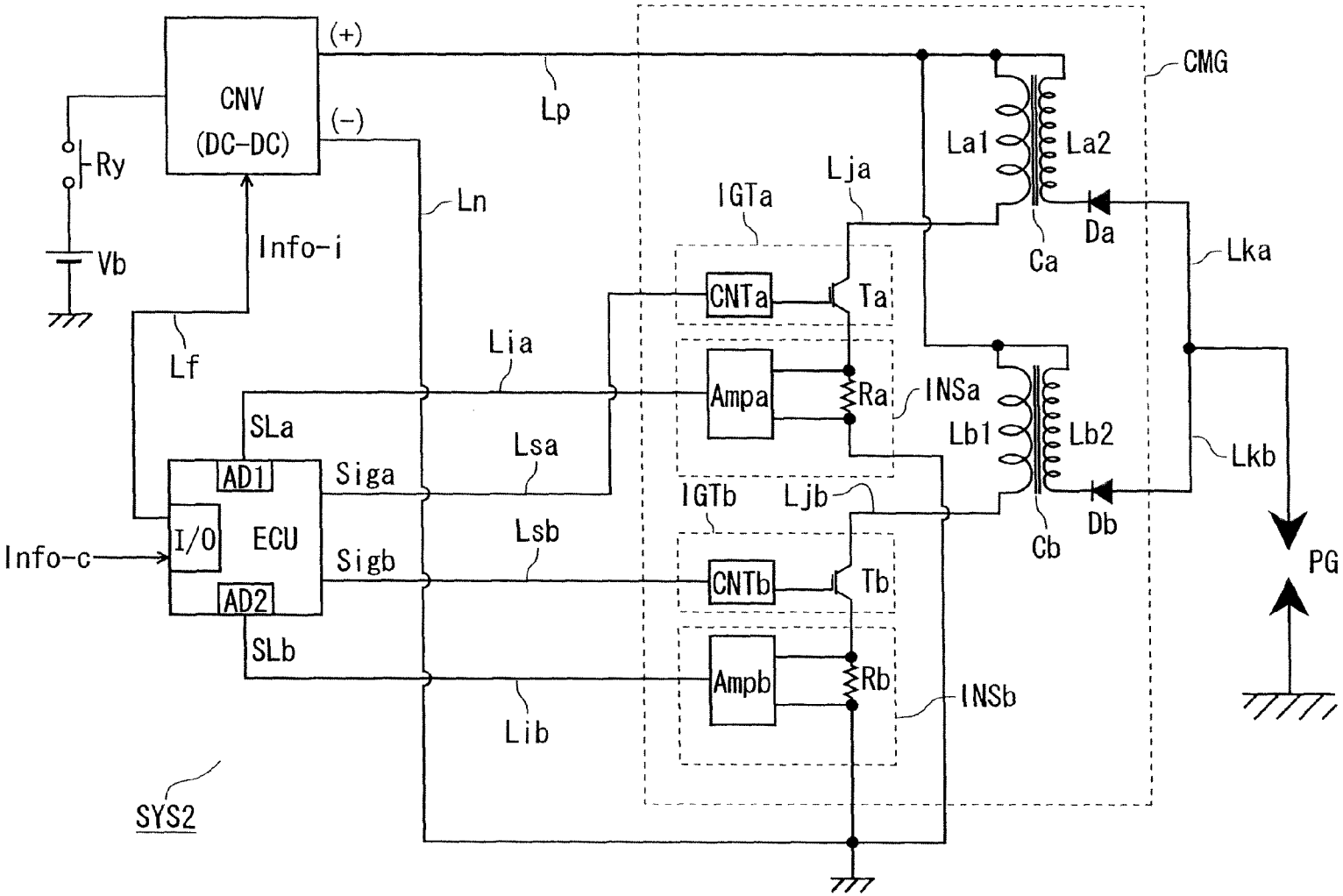
FIG. 10 illustrates a circuit configuration of an ignition system according to Embodiment 2.

FIG. 10 illustrates an ignition system according to Embodiment 2. An ignition system SYS2 according to Embodiment 2 is different from the ignition system SYS 1 according to Embodiment 1 in the engine control unit ECU, the DC-DC converter CNV, and the peripheral signal lines. Description of the components to which no changes are made will be omitted for the sake of convenience.

As illustrated in FIG. 10, the engine control unit ECU is equipped with an A/D port (AD1) and an A/D port (AD2). The A/D port (AD1) is connected to the primary current detection circuit INSa via the signal line Lia, and the A/D port (AD2) is connected to the primary current detection circuit INSb via the signal line Lib. And, the A/D port (AD1) is fed the primary current detection signal SLa, while the A/D port (AD2) is fed the primary current detection signal SLb.

The engine control unit ECU performs A/D conversion on the primary current detection signal SLa and the primary current detection signal SLb to generate information corresponding to the signal SLa and information corresponding to the signal SLb, respectively. Then, these information are outputted as current value information Info-i from the I/O circuit, and supplied to the DC-DC converter CNV via a signal line Lf. The current value information Info-i is received and transmitted via an information communication network such as a LIN (Local Interconnect Network).

Figure 11:
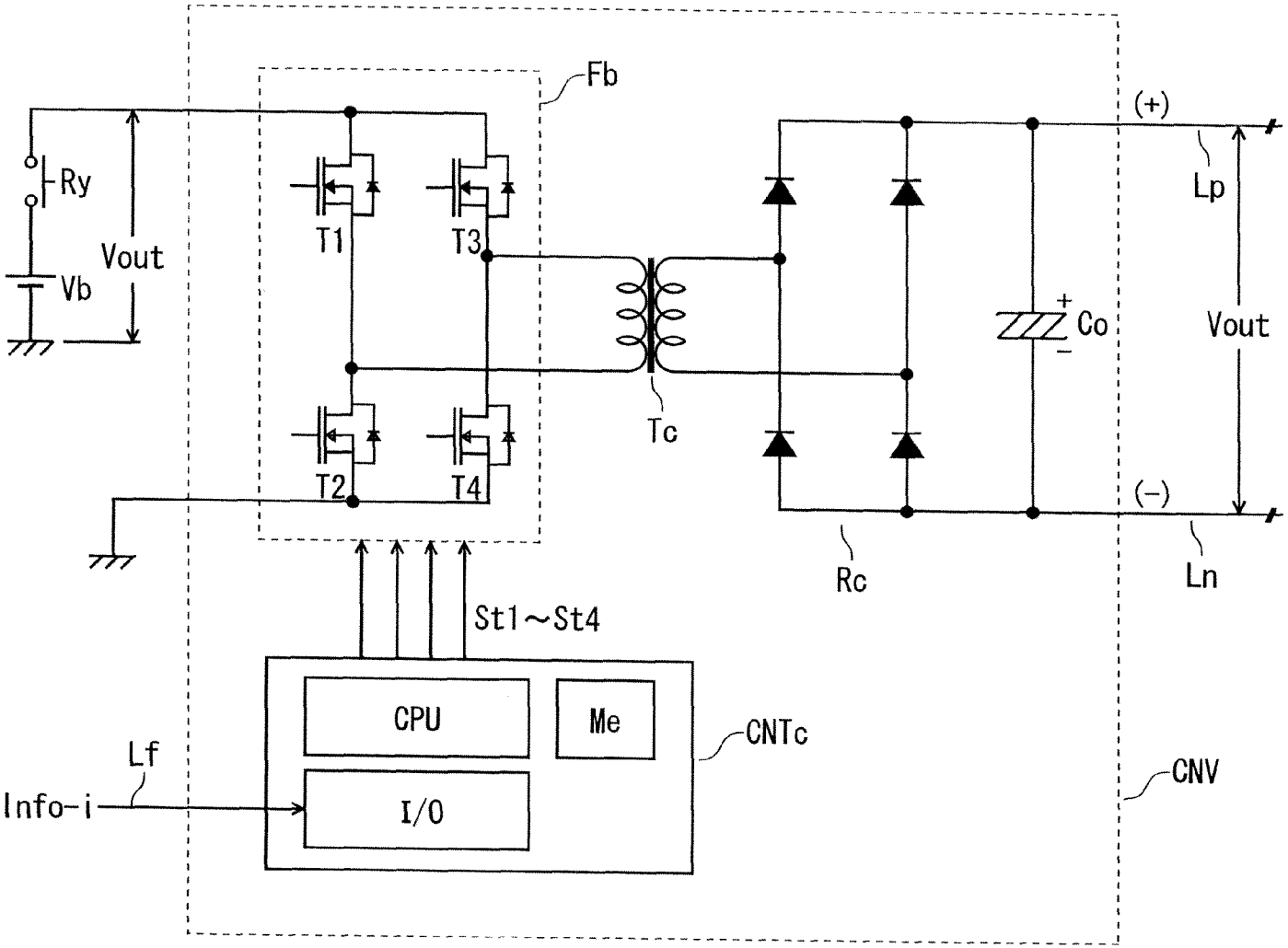
FIG. 11 illustrates a circuit configuration of a DC-DC converter according to Embodiment 2.

As illustrated in FIG. 11, the control circuit CNTc for carrying out control of the DC-DC converter CNV includes an arithmetic circuit CPU, a memory circuit Me, and an information input/output circuit I/O. The current value information Info-i is inputted to the information input/output circuit I/O through the signal line Lf, and based on this current value information Info-i, the primary current Ia1 of the spark coil Ca and the primary current Ib1 of the spark coil Cb are recognized in the DC-DC converter CNV.

Further, as mentioned above, the DC-DC converter CNV adjusts output power to be supplied to each primary coil in accordance with a change in the primary current to thereby control an increase rate of the primary current so that the primary current is brought close to the threshold I1*th* at the end of the switching period To.

Embodiment 3

Figure 12:
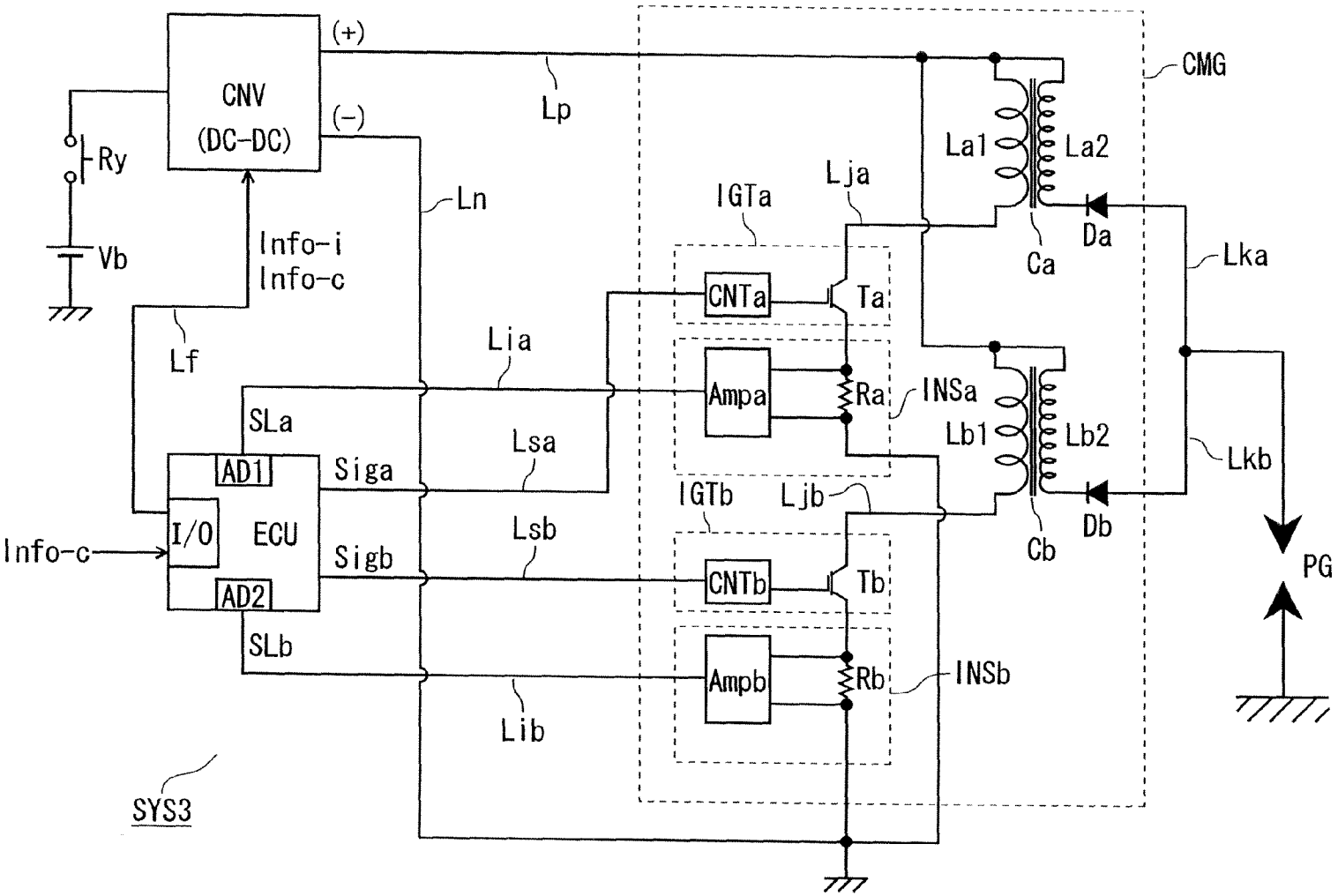
FIG. 12 illustrates a circuit configuration of an ignition system according to Embodiment 3.

FIG. 12 illustrates an ignition system according to Embodiment 3. In an ignition system SYS3 according to Embodiment 3, the operating state information Info-c and the current value information Info-i are outputted from the engine control unit ECU. Furthermore, based on the operating state information Info-c and the current value information Info-i, the DC-DC converter CNV adjusts output power to control the primary current of each spark coil.

More specifically, the control circuit CNTc for carrying out control of the DC-DC converter CNV controls the primary currents Ia1 and Ib1 based on new mapped information. In accordance with the operating state information Info-c, detailed case analysis is performed on the mapped information according to this embodiment. For example, load states (high load to low load) of an internal combustion engine or the numbers of revolutions thereof are divided into plural stages, and in accordance with these operating states, driving signals for the transistors T1 to T4 corresponding to the current value information Info-i are set.

Figure 13:
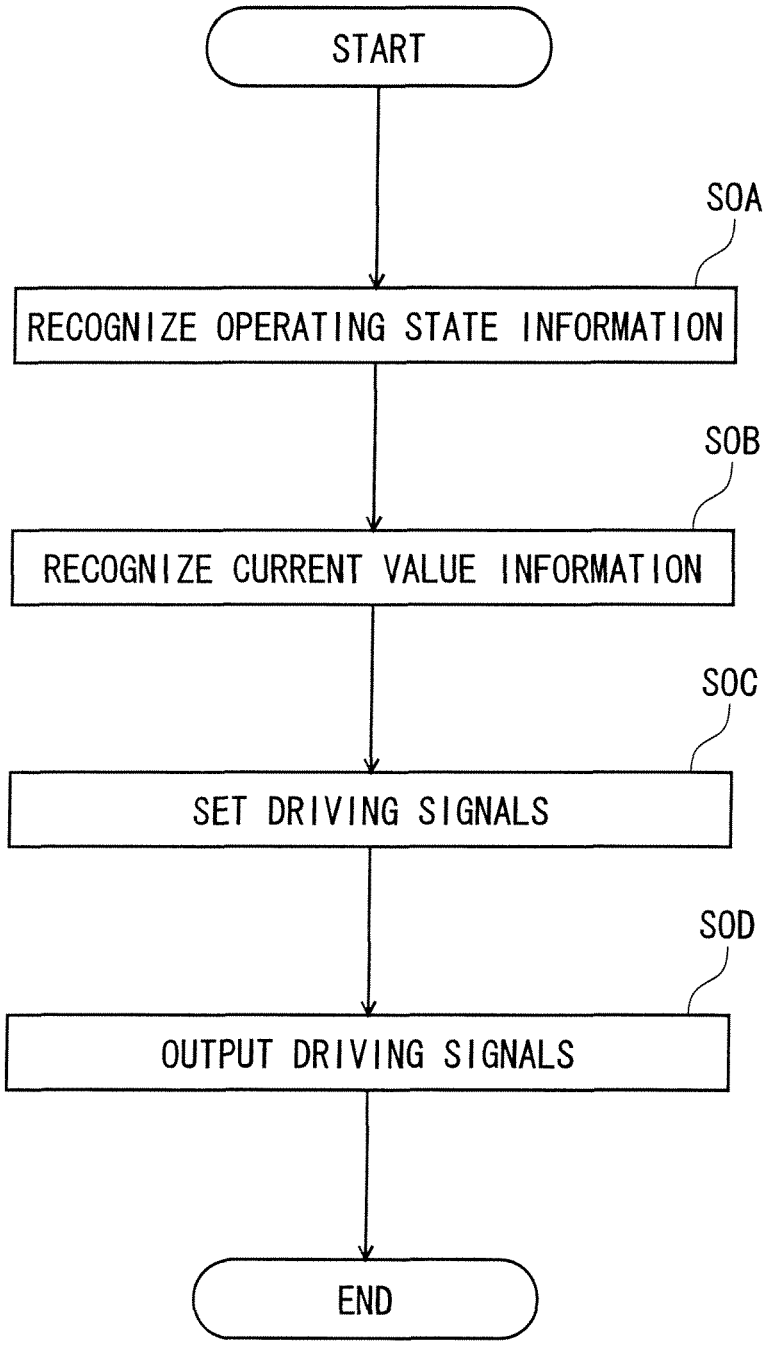
FIG. 13 is a flow chart for controlling an output current.

FIG. 13 illustrates a flow chart of a control program incorporated into the memory circuit Me of the control circuit CNTc. In this control circuit CNTc, a set of mapped information concerning a given operating state is determined based on the operating state information Info-c (step S0A). In this step S0A, the appropriate primary current threshold I1*th* is set based on a condition such as whether the load state is high or low.

Subsequently, in a current value information recognition step S0B, the inputted current value information Info-i is acquired. In a driving signal setting step S0C, from the set of mapped information, the mapped information corresponding to the current value information Info-i is selected, and information on driving signals corresponding to the current value information Info-i is given to the arithmetic circuit CPU. Then, in a driving signal output step S0D, the driving signals St1 to St4 are generated based on this information, and these driving signals are outputted, thereby driving the respective switching elements T1 to T4.

Figure 14:
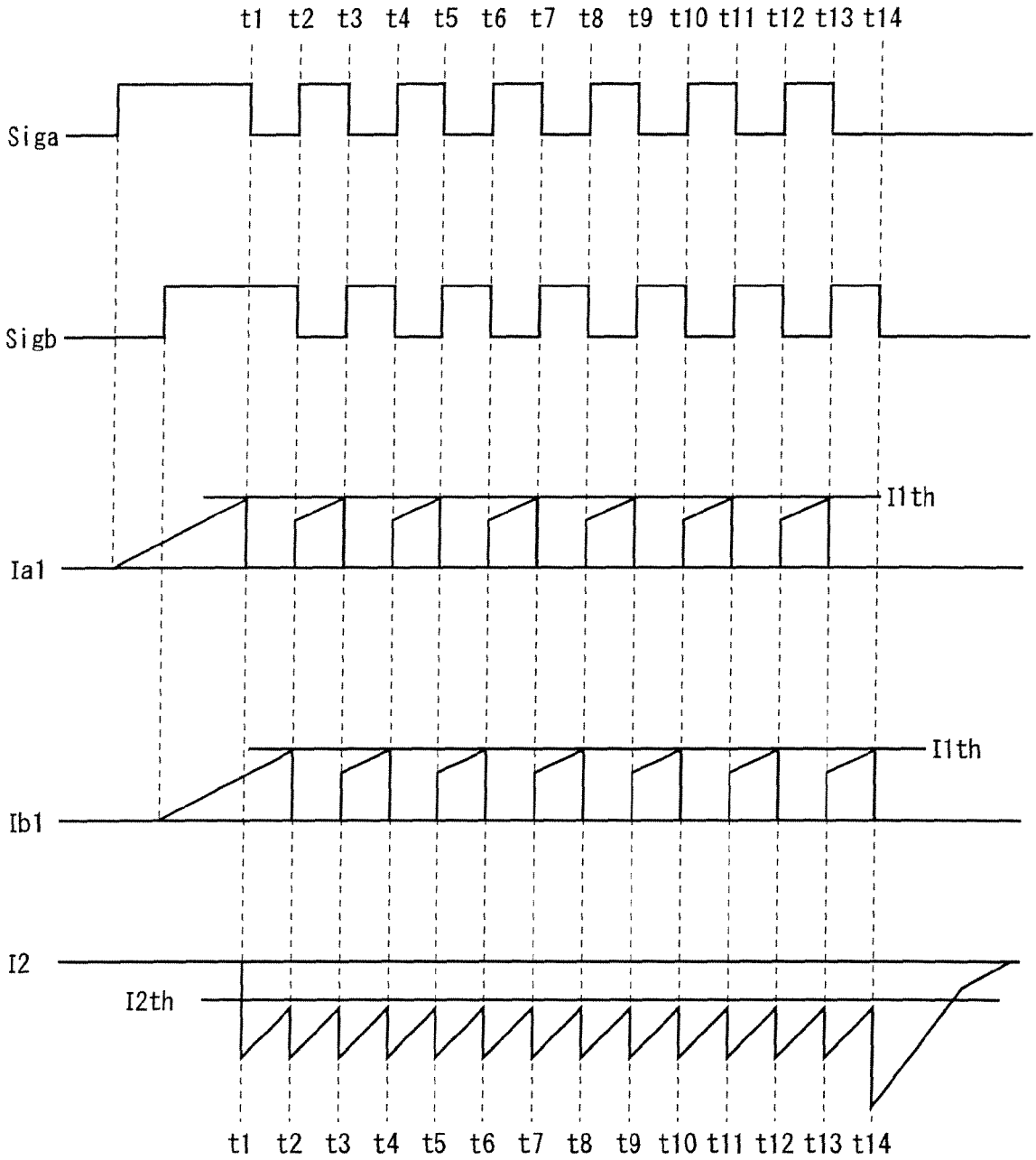
FIG. 14 is a timing chart illustrating spark signals, primary currents and a discharge current according to Embodiment 3.

As indicated in "BACKGROUND", the falling of the discharge current I2 might be steep as illustrated in FIG. 14 when the internal combustion engine is operated in a high load state. However, in the ignition system SYS3 according to Embodiment 3, the primary current is appropriately adjusted based on the operating state (i.e., the operating state information Info-c) of the internal combustion engine, and therefore, the primary current will be raised to an appropriate level. Hence, the discharge current I2 will not fall below the discharge current threshold I2*th*, and the discharge state will be suitably maintained during a discharge request period.

That is, in the ignition system SYS3 according to Embodiment 3, a change in the discharge current I2 is predicted in advance based on the operating state of the internal combustion engine, and the DC-DC converter CNV is controlled in accordance with the change in the discharge current I2, thereby more reliably maintaining the stable discharge state in which no discharge interruption occurs.

Figure 15:
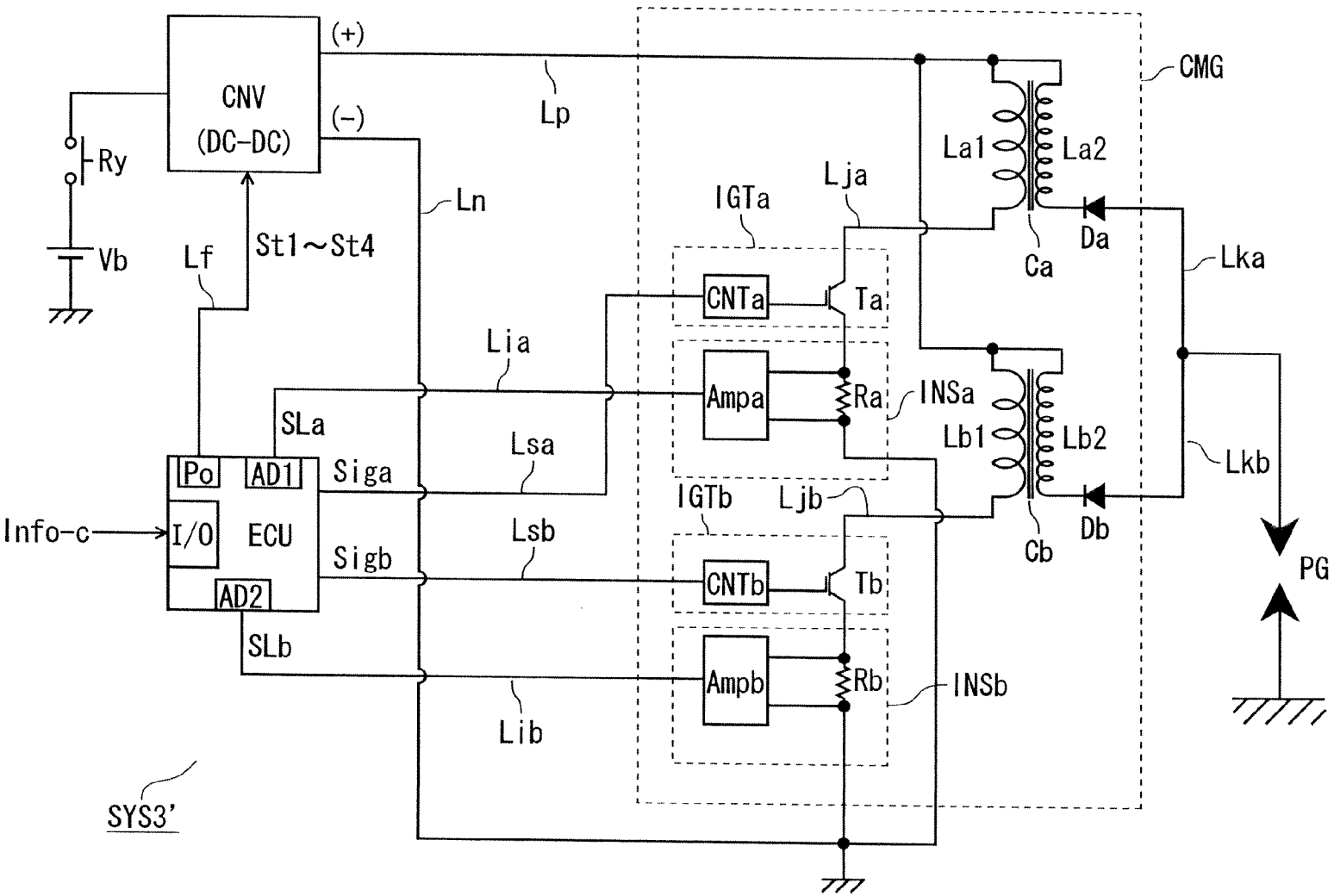
FIG. 15 illustrates a circuit configuration of an ignition system according to a variation of Embodiment 3.

FIG. 15 illustrates an ignition system according to a variation of Embodiment 3. An ignition system SYS3' according to the variation of Embodiment 3 is configured so that the driving signals St1 to St4 are outputted directly from the engine control unit ECU.

This engine control unit ECU selects a set of mapped information in accordance with operation information, generates, from this mapped information, the driving signals St1 to St4 based on the primary current, and outputs the generated driving signals St1 to St4.

Further, in the DC-DC converter CNV, the driving signals St1 to St4 received from the engine control unit ECU are directly applied to the full-bridge circuit Fb, thus appropriately controlling the primary current.

That is, the ignition system SYS3' illustrated in FIG. 15 and the ignition system SYS3 illustrated in FIG. 12 have a commonality in that the primary current threshold I1*th* is set based on the operating state of the internal combustion engine; thus, also in the ignition system illustrated in FIG. 15, a change in the discharge current is predicted in advance based on the operating state of the internal combustion engine, and the DC-DC converter CNV is controlled in accordance with the change in the discharge current. Hence, also in the ignition system illustrated in FIG. 15, the stable discharge state in which no discharge interruption occurs will be maintained.

Embodiment 4

Figure 16:
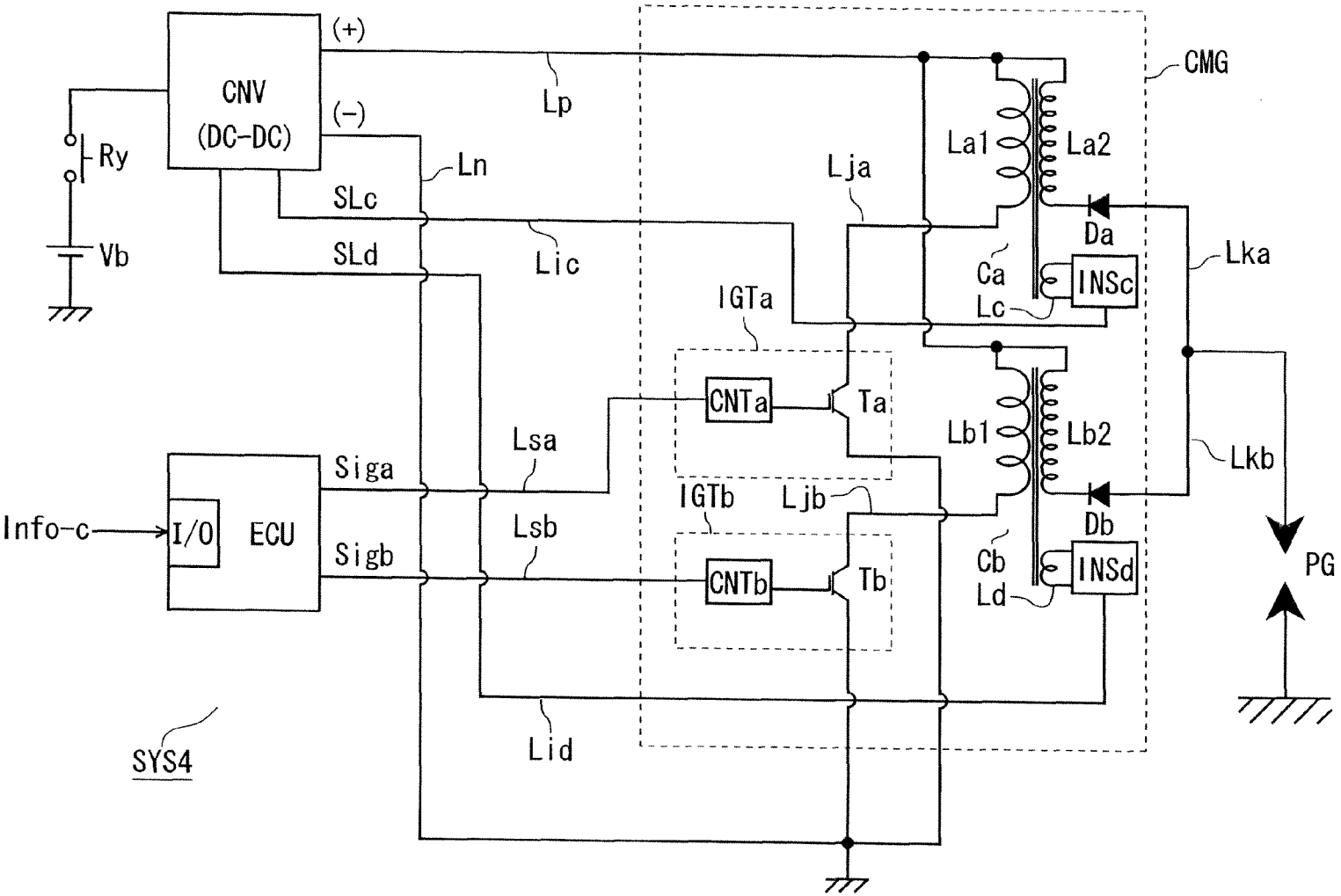
FIG. 16 illustrates a circuit configuration of an ignition system according to Embodiment 4.

FIG. 16 illustrates an ignition system according to Embodiment 4. In an ignition system SYS4 according to Embodiment 4, the primary current detection circuits INSa and INSb provided for the primary sides in Embodiment 1 are removed, and instead of these primary current detection circuits, secondary current detection circuits INSc and INSd are provided for the secondary sides of the spark coils Ca and Cb, respectively.

In the secondary current detection circuit INSc, a sensor coil Lc is wound around an iron core of the spark coil Ca, a change in a magnetic flux is received, thus detecting the secondary current of the spark coil Ca. Similarly, in the secondary current detection circuit INSd, a sensor coil Ld is wound around an iron core of the spark coil Cb.

The secondary current detection circuits INSc and INSd respectively output the secondary current detection signals SLc and SLd, and the detection signals SLc and SLd are fed to the DC-DC converter CNV respectively through signal lines Lic and Lid.

The secondary current detection circuits are not limited to the above-mentioned configurations, but may be replaced with various known sensors. Furthermore, while the secondary current detection module is realized by the secondary current detection circuits INSc and INSd in this embodiment, for example, the secondary current detection module may be realized by single circuit.

In this embodiment, driving signals for the full-bridge circuit Fb in the DC-DC converter CNV are naturally set based on the threshold I2*th* for the discharge current I2.

In the ignition system SYS4, the secondary current of each spark coil is detected, thereby directly grasping the state of the discharge current I2. For example, when control is carried out so that the output of the DC-DC converter CNV is raised in response to occurrence of a discharge interruption, the discharge interruption can be eliminated immediately after the occurrence thereof, and the discharge current can be maintained with more stability.

Embodiment 5

Figure 17:
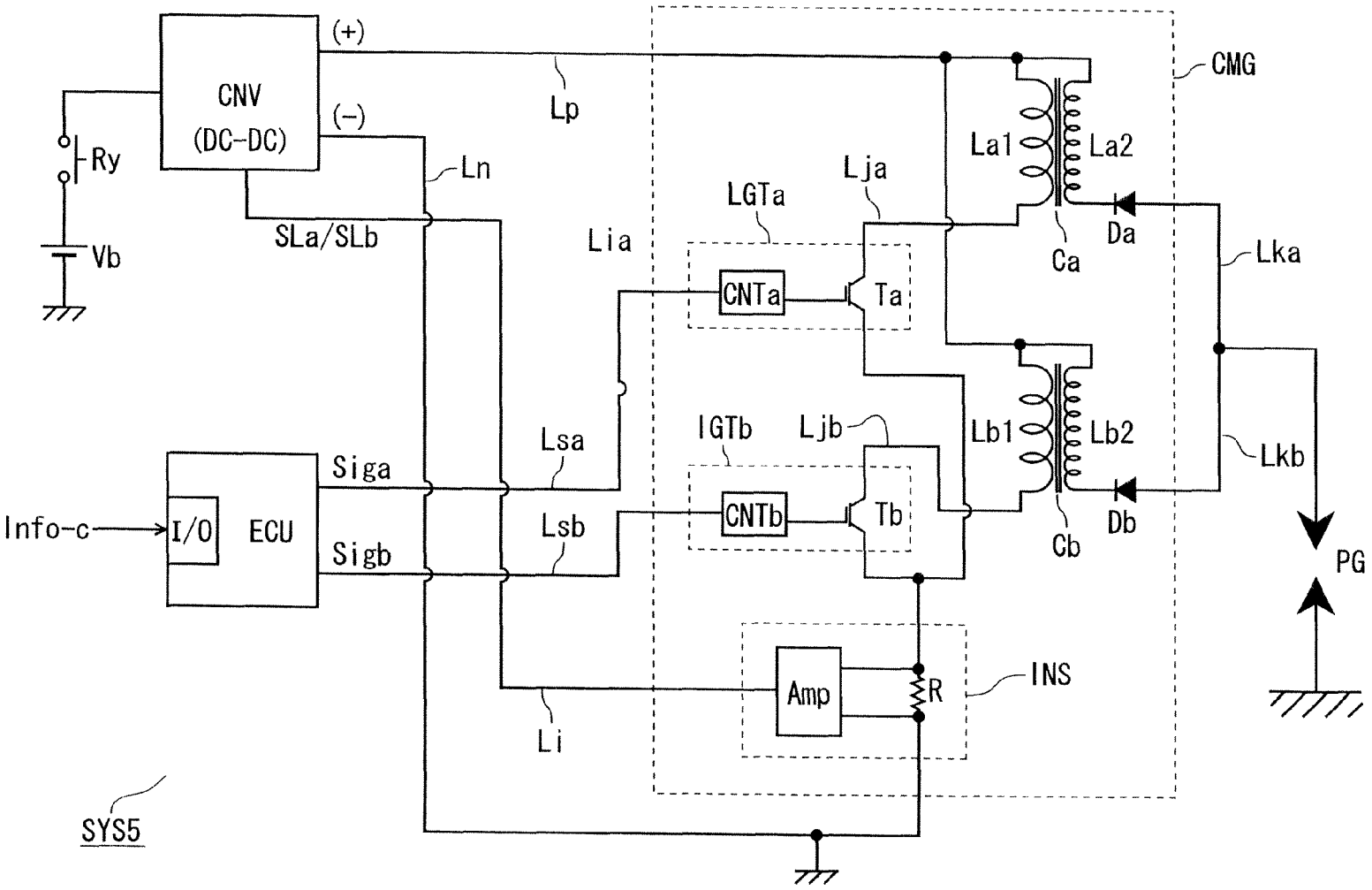
FIG. 17 illustrates a circuit configuration of an ignition system according to Embodiment 5.
Figure 18:
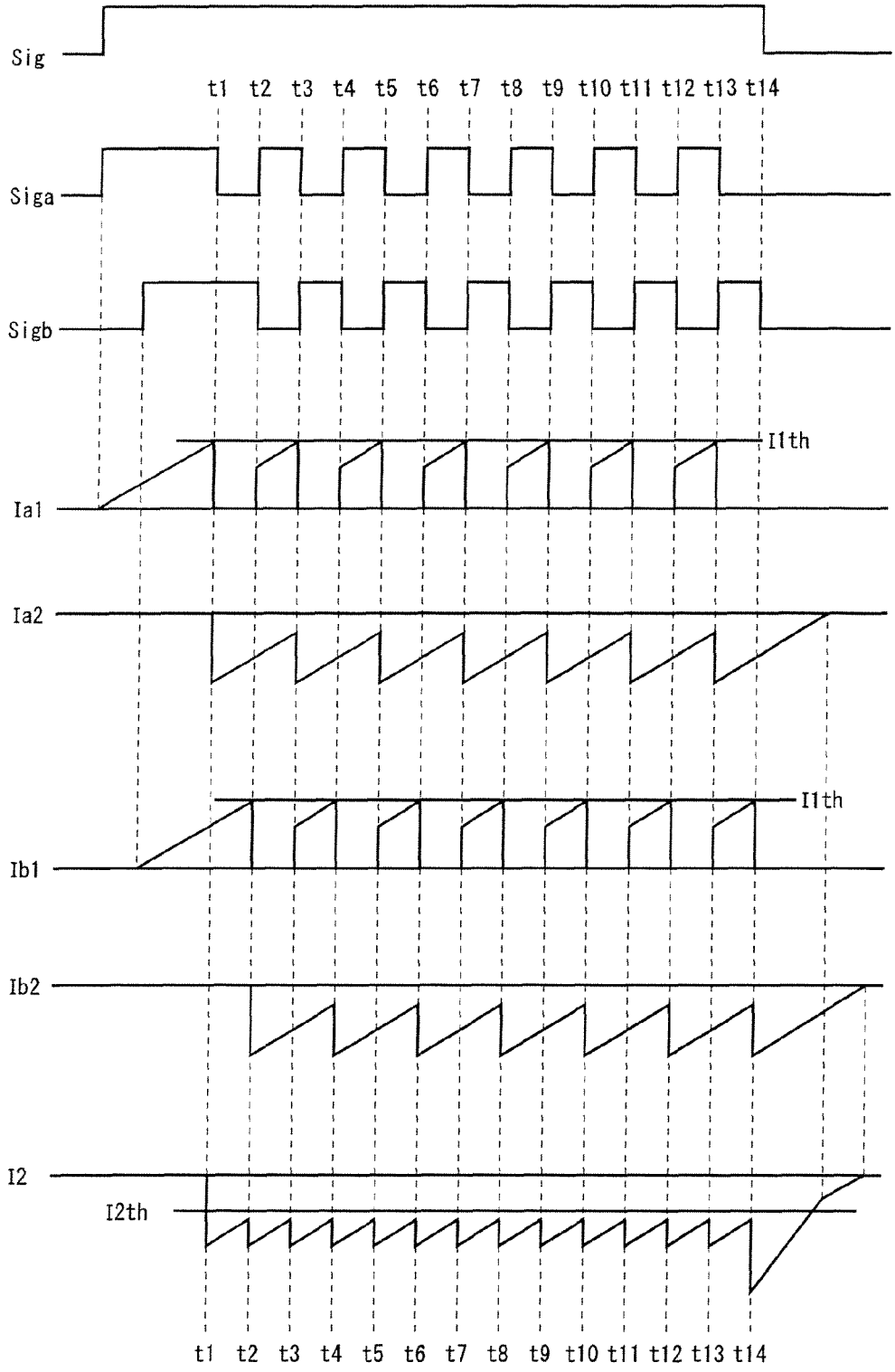
FIG. 18 is a timing chart illustrating states of ideal primary and secondary currents for continuing a discharge time for a given period of time.
Figure 19:
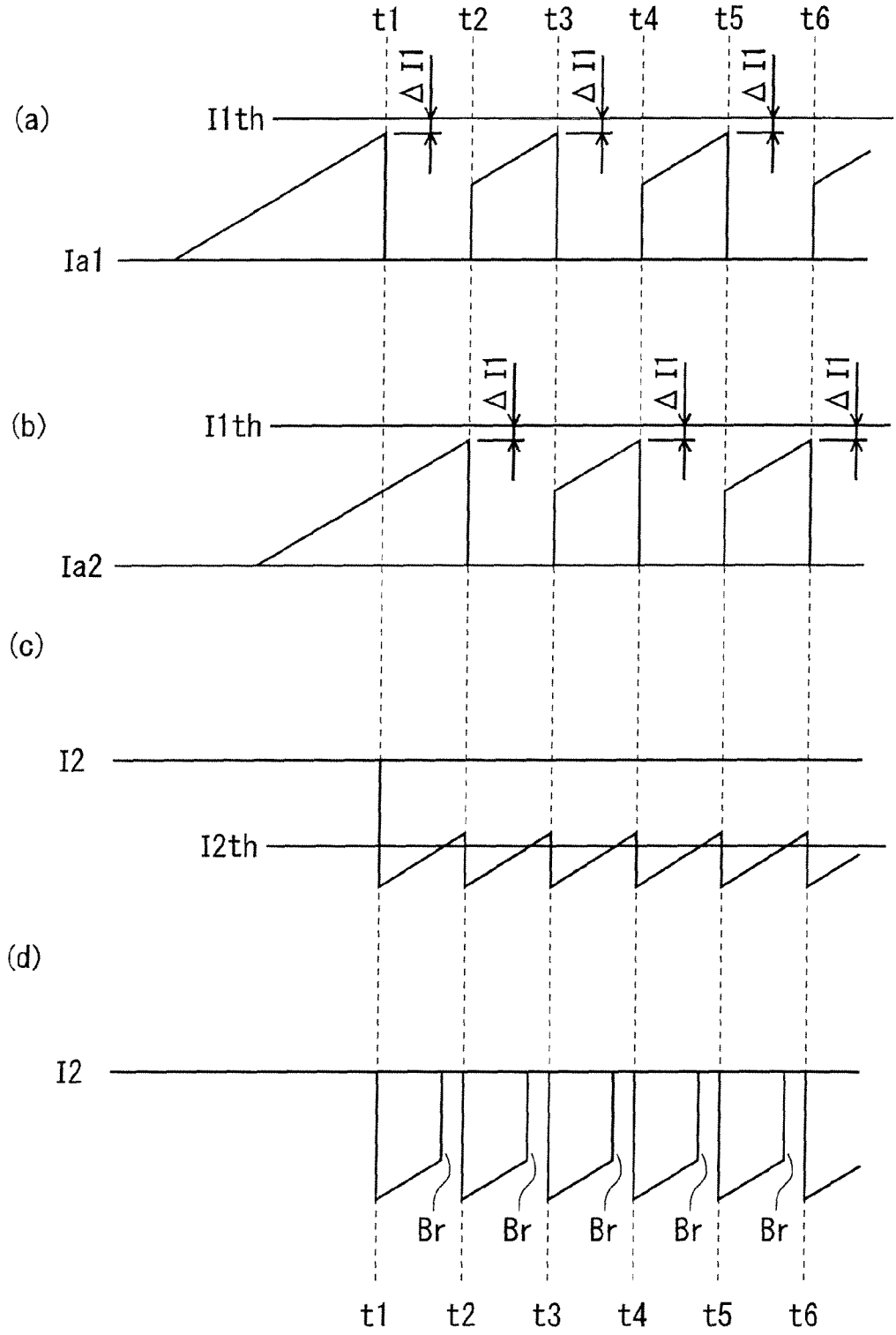
FIG. 19 illustrates a phenomenon that occurs when a primary current has not reach a threshold.
Figure 20:
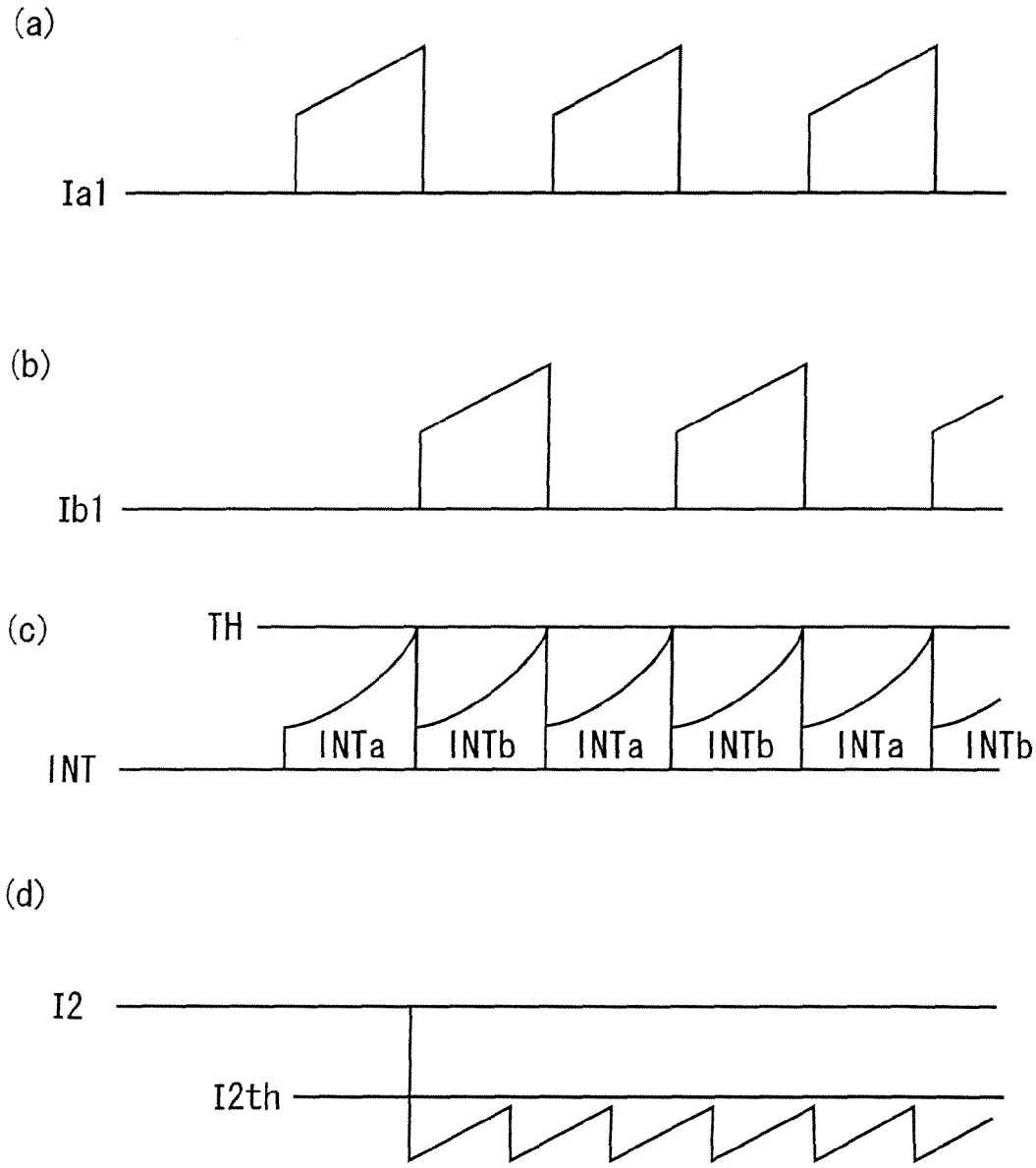
FIG. 20 illustrates a technique for controlling a primary current energization time.
Figure 21:
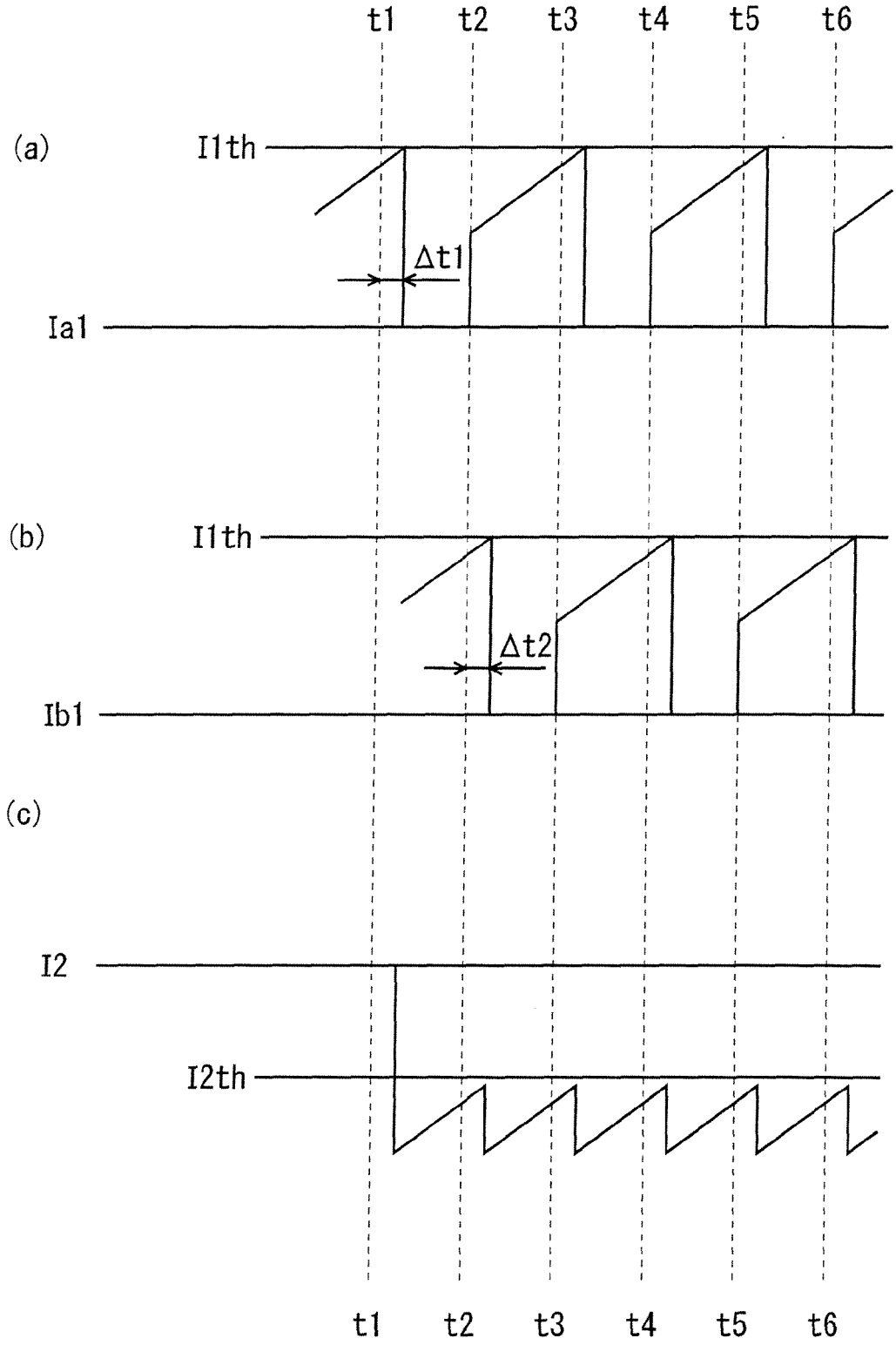
FIG. 21 illustrates a technique for controlling a primary current energization time.
Figure 22:
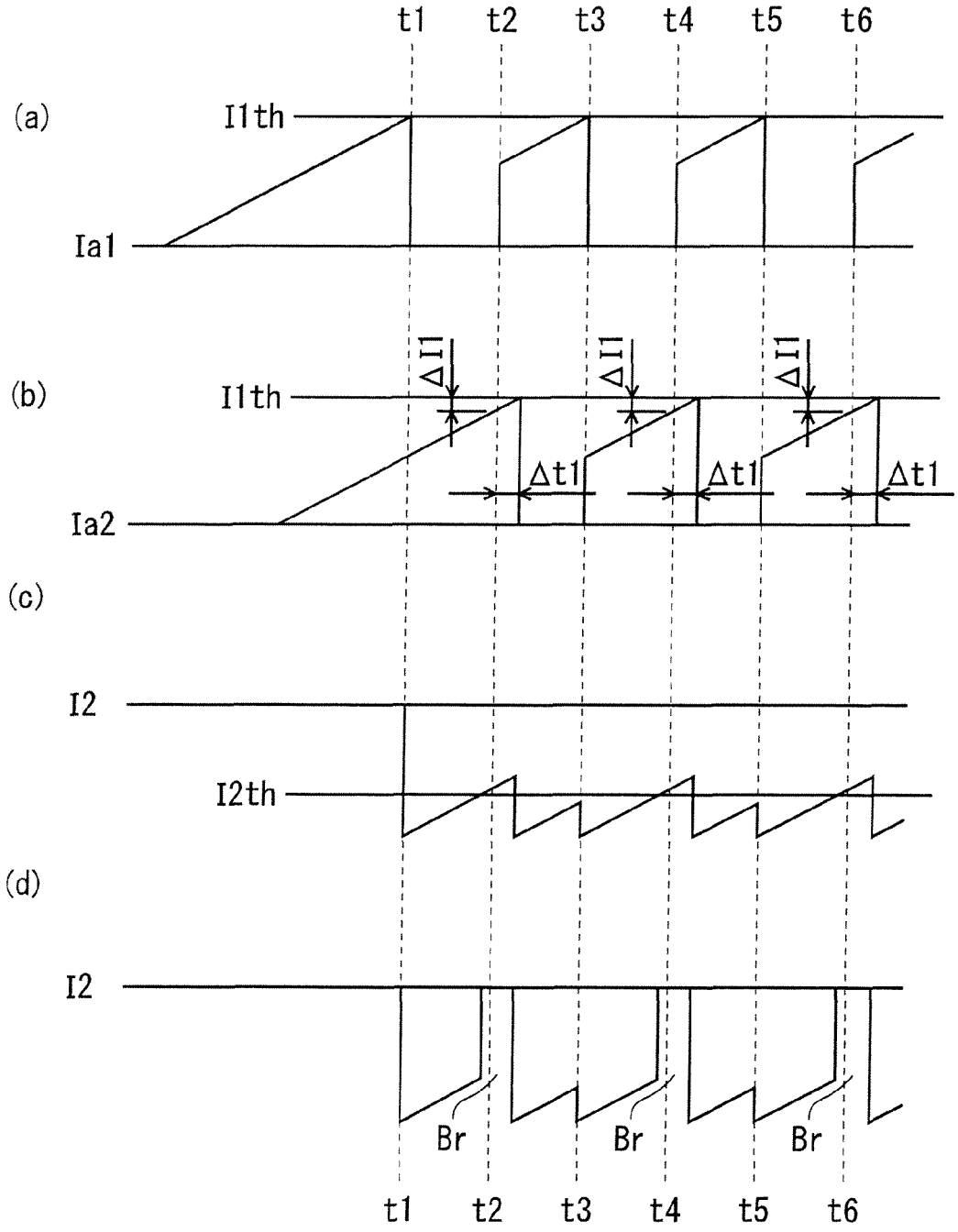
FIG. 22 illustrates a problem that occurs when a primary current energization time is controlled.
Figure 23:
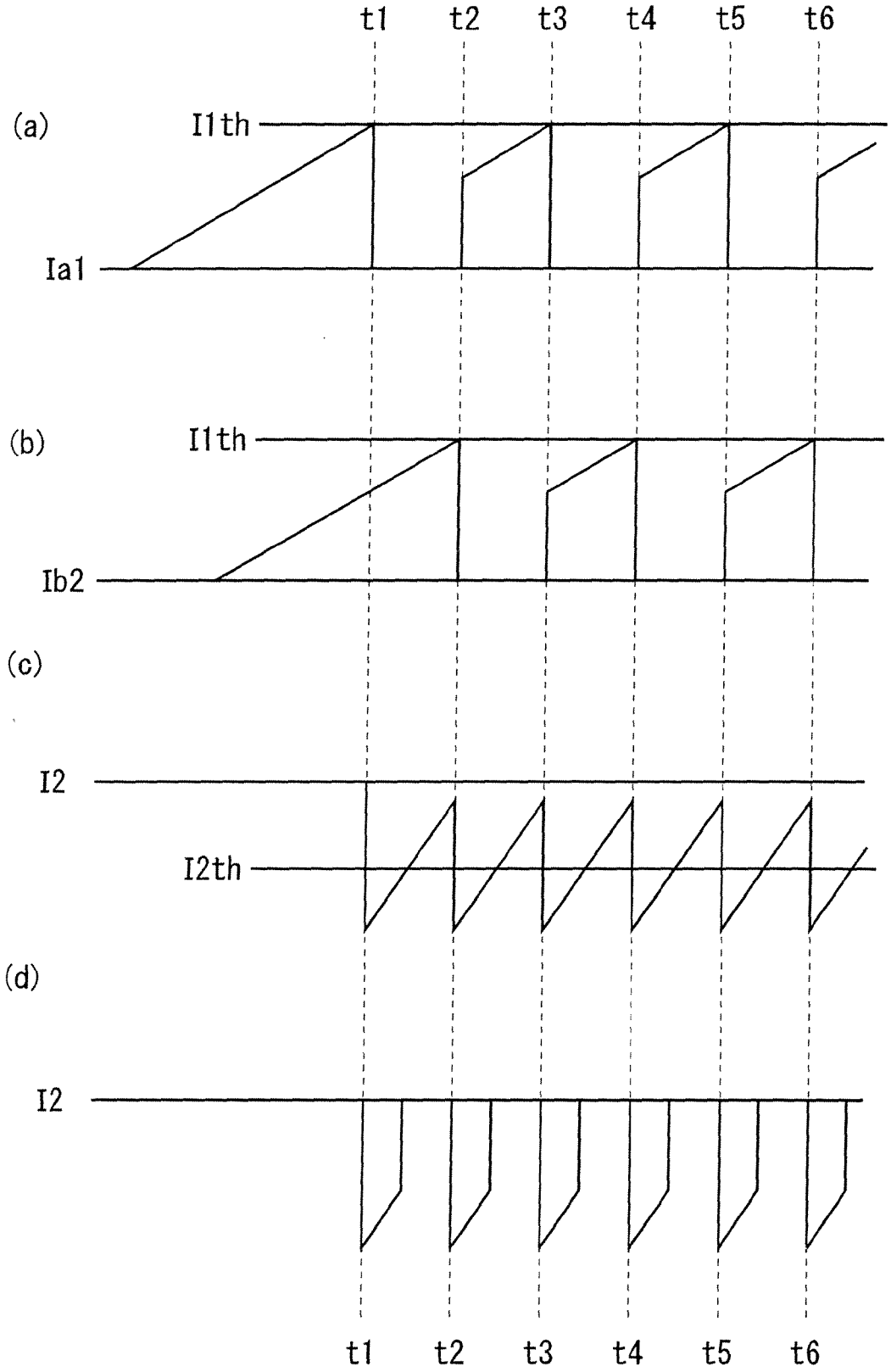
FIG. 23 illustrates a problem that occurs when a secondary current is steeply reduced.

FIG. 17 illustrates an ignition system according to Embodiment 5. An ignition system SYS5 according to Embodiment 5 includes a single primary current detection circuit INS (primary current detection module), the input side of which is wired to both of the switching elements Ta and Tb and the output side of which is connected to the DC-DC converter CNV via a signal line Li. The primary current detection circuit INS includes a shunt resistor R and a sensor circuit Amp. In this embodiment, the primary currents generated in the spark coils Ca and Cb are alternately inputted to the primary current detection circuit INS, and in response to this, the primary current detection signals SLa and SLb are outputted therefrom.

The DC-DC converter CNV detects the output timing of the spark signals Siga and Sigb outputted from the engine control unit ECU (no illustration is given on this detection) to thereby determine whether a detected signal is either the primary current detection signal SLa or the primary current detection signal SLb. Also, in the DC-DC converter CNV, a distinction is made between the timing at which electric power is supplied to the spark coil Ca and the timing at which electric power is supplied to the spark coil Cb, and an output voltage is appropriately controlled in accordance with the timing.

As exemplified in Embodiment 5, the primary current detection circuits can be integrated into the single circuit, thereby simplifying the circuit configuration of the ignition system. The primary current detection circuit is not limited to the configuration illustrated in FIG. 17, but a known technique may be applied thereto.

The present invention is not limited to the above-mentioned embodiments, but various modifications may be made within the scope of the present invention. For example, a DC-DC converter is exemplified as the primary current control module in the above-mentioned embodiments. However, the "primary current control module" is not limited thereto. For example, in an ignition system to which regenerated electric power of a power motor or electric power of an alternator is supplied, an AC-DC converter may be adopted as the primary current control module.

The invention claimed is:

1. An internal combustion engine ignition system, comprising:

a plurality of spark coils each having a primary coil and a secondary coil, each secondary coil being coupled to a common spark plug to apply a high voltage thereto;

a plurality of primary current generation module provided correspondingly with the spark coils and configured to asynchronously generate primary currents respectively flowing through the primary coils;

one or a plurality of primary current detection module configured to detect each of the primary currents; and a primary current control module configured to adjust an output power supplied to each primary coil in accordance with a change in the primary current to thereby control an increase rate of the primary current.

2. The ignition system of claim 1, wherein the primary current control module controls the increase rate of the primary current so that the primary current reaches a preset threshold before a next switching timing.

3. The ignition system of claim 2, wherein the threshold is set based on an operating state of an internal combustion engine.

4. The ignition system of claim 3, further comprising:

an engine control unit configured to output a spark signal to the primary current generation module based on the operating state of the internal combustion engine, and wherein the engine control unit performs:

a process of setting the threshold based on the operating state of the internal combustion engine; and a process of generating and outputting a driving signal for the primary current control module based on the set threshold and a primary current detection signal outputted from the primary current detection module.

5. The ignition system of claim 2, wherein the primary current control module performs a process of increasing the output power when the primary current falls below the threshold.

6. The ignition system of claim 5, wherein the primary current control module further performs a process of reducing the output power when the primary current exceeds the threshold.

7. The ignition system of claim 1, wherein the primary current control module adjusts the output power based on a primary current detection signal outputted from the primary current detection module.

8. The ignition system of claim 1, wherein the primary current control module is a DC-DC converter configured to generate the output power from a car-mounted battery.

9. An internal combustion engine ignition system, comprising:

a plurality of spark coils each having a primary coil and a secondary coil, each secondary coil being coupled to a common spark plug to apply a high voltage thereto;

a plurality of primary current generation module provided correspondingly with the spark coils and configured to asynchronously generate primary currents respectively flowing through the primary coils;

one or a plurality of secondary current detection module configured to detect each of secondary currents respectively flowing through the secondary coils; and a primary current control module configured to adjust an output power supplied to each primary coil in accordance with a change in the secondary current to thereby control an increase rate of the primary current.

10. The ignition system of claim 9, wherein the primary current control module controls the increase rate of the primary current so that the secondary current reaches a preset threshold before a next switching timing.

11. The ignition system of claim 10, wherein the threshold is set based on an operating state of an internal combustion engine.

12. The ignition system of claim 11, further comprising:

an engine control unit configured to output a spark signal to the primary current generation module based on the operating state of the internal combustion engine, and wherein the engine control unit performs:

a process of setting the threshold based on the operating state of the internal combustion engine; and a process of generating and outputting a driving signal for the primary current control module based on the set threshold and a secondary current detection signal outputted from the secondary current detection module.

13. The ignition system of claim 9, wherein the primary current control module adjusts the output power based on a secondary current detection signal outputted from the secondary current detection module.

* * * * *